US009241223B2

(12) United States Patent
Chu et al.

(10) Patent No.: US 9,241,223 B2
(45) Date of Patent: Jan. 19, 2016

(54) DIRECTIONAL FILTERING OF AUDIBLE SIGNALS

(71) Applicant: Malaspina Labs (Barbados), Inc., Vancouver (CA)

(72) Inventors: Clarence S. H. Chu, Vancouver (CA); Alireza Kenarsari Anhari, Vancouver (CA); Alexander Escott, Vancouver (CA); Shawn E. Stevenson, Burnaby (CA); Pierre Zakarauskas, Vancouver (CA)

(73) Assignee: Malaspina Labs (Barbados) Inc., Upton, St. Michael (BB)

( * ) Notice: Subject to any disclaimer, the term of this patent is extended or adjusted under 35 U.S.C. 154(b) by 106 days.

(21) Appl. No.: 14/169,613

(22) Filed: Jan. 31, 2014

(65) Prior Publication Data

US 2015/0222996 A1 Aug. 6, 2015

(51) Int. Cl.
*H04R 25/00* (2006.01)
*H04R 3/00* (2006.01)

(52) U.S. Cl.
CPC ..... *H04R 25/40* (2013.01); *H04R 3/005* (2013.01); *H04R 25/43* (2013.01); *H04R 2430/23* (2013.01)

(58) Field of Classification Search
CPC ..... H04R 3/005; H04R 25/407; H04R 1/326; H04M 3/568
See application file for complete search history.

(56) References Cited

U.S. PATENT DOCUMENTS

| | | | | |
|---|---|---|---|---|
| 6,549,630 | B1 | 4/2003 | Bobisuthi | |
| 7,181,034 | B2 * | 2/2007 | Armstrong | 381/321 |
| 7,274,794 | B1 * | 9/2007 | Rasmussen | 381/92 |
| 2003/0142836 | A1 * | 7/2003 | Warren | H04R 25/407 381/92 |
| 2005/0195988 | A1 * | 9/2005 | Tashev | H04R 3/005 381/92 |
| 2008/0317260 | A1 | 12/2008 | Short | |
| 2014/0023199 | A1 | 1/2014 | Giesbrecht | |

OTHER PUBLICATIONS

Extended European Search Report for corresponding European Appl. No. 14200177.5 dated Jun. 15, 2015.

* cited by examiner

*Primary Examiner* — Tuan D Nguyen

(57) ABSTRACT

Various implementations described herein include directional filtering of audible signals, which is provided to enable acoustic isolation and localization of a target voice source. Without limitation, various implementations are suitable for speech signal processing applications in, hearing aids, speech recognition software, voice-command responsive software and devices, telephony, and various other applications associated with mobile and non-mobile systems and devices. In particular, some implementations include systems, methods and/or devices operable to emphasize at least some of the time-frequency components of an audible signal that originate from a target direction and source, and/or deemphasizing at least some of the time-frequency components that originate from one or more other directions or sources. In some implementations, directional filtering includes applying a gain function to audible signal data received from multiple audio sensors. In some implementations, the gain function is determined from the audible signal data and target values associated with directional cues.

46 Claims, 12 Drawing Sheets

DIRECTIONAL FILTERING OF AUDIBLE SIGNALS

TECHNICAL FIELD

The present disclosure generally relates to audio signal processing, and in particular, to processing components of audible signal data based on directional cues.

BACKGROUND

The ability to localize, recognize, isolate and interpret voiced sounds of another person are some of the most relied upon functions performed by the human auditory system. However, spoken communication often occurs in adverse acoustic environments including ambient noise, acoustic interference, and competing voices. Acoustic environments that include multiple speakers are particularly challenging because voices generally each have similar average characteristics and arrive from various angles. Nevertheless, acoustic isolation and localization of a target voice source are hearing tasks that unimpaired-hearing listeners are able to accomplish effectively, even in highly adverse acoustic environments. On the other hand, hearing-impaired listeners have more difficulty localizing, recognizing, isolating and interpreting a target voice even in favorable acoustic environments.

Previously available hearing aids typically utilize methods that improve sound quality in terms of simple amplification and listening comfort. However, such methods do not substantially improve speech intelligibility or aid a user's ability to identify the direction of a target voice source. One reason for this is that it is particularly difficult using previously known signal processing methods to adequately reproduce in real time the acoustic isolation and localization functions performed by the unimpaired human auditory system. Additionally, previously available methods that are used to improve listening comfort actually degrade speech intelligibility and directional auditory cues by removing audible information.

The problems stemming from inadequate acoustic isolation and localization signal processing methods are also experienced in machine listening applications utilized by mobile and non-mobile devices. For example, with respect to smartphones, wearable devices and on-board vehicle navigation systems, the performance of voice encoders used for telephony and systems using speech recognition and voice commands typically suffer in acoustic environments that are even slightly adverse.

SUMMARY

Various implementations of systems, methods and devices within the scope of the appended claims each have several aspects, no single one of which is solely responsible for the attributes described herein. Without limiting the scope of the appended claims, some prominent features are described. After considering this disclosure, and particularly after considering the section entitled "Detailed Description," one will understand how the aspects of various implementations are used to enable directional filtering of audible signal data received by two or more audio sensors.

To those ends, some implementations include systems, methods and devices operable to at least one of emphasize a portion of an audible signal that originates from a target direction and source, and deemphasize another portion that originates from one or more other directions and sources. In some implementations, directional filtering includes applying a gain function to one or more portions of audible signal data received from two or more audio sensors. In some implementations, the gain function is determined based on a combination of the audible signal data and one or more target values associated with directional cues.

Some implementations include a method of directionally filtering portions of an audible signal. In some implementations, the method includes: determining one or more directional indicator values from composite audible signal data, the composite audible signal data including a respective audible signal data component from each of a plurality of audio sensors; determining a gain function from the one or more directional indicator values, the gain function targeting one or more portions of the composite audible signal data; and filtering the composite audible signal data using the gain function in order to produce directionally filtered audible signal data, the directionally filtered audible signal data including one or more portions of the composite audible signal data that have been changed by filtering with the gain function.

Some implementations include a directional filter including a processor and a non-transitory memory including instructions for directionally filtering portions of an audible signal. More specifically, the instructions when executed by the processor cause the directional filter to: determine one or more directional indicator values from composite audible signal data, the composite audible signal data including a respective audible signal data component from each of a plurality of audio sensors; determine a gain function from the one or more directional indicator values, the gain function targeting one or more portions of the composite audible signal data; and filter the composite audible signal data using the gain function in order to produce directionally filtered audible signal data, the directionally filtered audible signal data including one or more portions of the composite audible signal data that have been changed by filtering with the gain function.

Some implementations include a directional filter including a number of modules. For example, in some implementations a directional filter includes: a directional indicator value calculator configured to determine one or more directional indicator values from composite audible signal data, the composite audible signal data including a respective audible signal data component from each of a plurality of audio sensors; a gain function calculator configured to determine a gain function from the one or more directional indicator values, the gain function targeting one or more portions of the composite audible signal data; and a filter module configured to apply the gain function to the composite audible signal data in order to produce directionally filtered audible signal data. In some implementations, the directional filter also includes a windowing module configured to generate a plurality of temporal frames of the composite audible signal data, the composite audible signal data including a respective audible signal data component from each of a plurality of audio sensors. In some implementations, the directional filter also includes a sub-band decomposition module configured to convert the composite audible signal data into a plurality of time-frequency units. In some implementations, the directional filter also includes a temporal smoothing module configured to decrease a respective time variance value characterizing at least one of the one or more directional indicator values. In some implementations, the directional filter also includes a tracking module configured to adjust a target value associated with at least one of the one or more directional indicator values in response to an indication of voice activity in at least a portion of the composite audible signal data. In some implementations, the directional filter also includes a voice activity detector configured to provide a voice activity indicator value to the tracking module, the voice activity indicator value providing a representation of whether or not at least a portion of the composite audible signal data includes data indicative of voiced sound. In some implementations, the directional filter also includes a beamforming module configure to combine the respective audible signal data components in order to one of enhance signal components associated with a particular direction, and attenuate signal components associated with other directions.

Some implementations include a directional filter including: means for determining one or more directional indicator values from composite audible signal data, the composite audible signal data including a respective audible signal data component from each of a plurality of audio sensors; means for determining a gain function from the one or more directional indicator values, the gain function targeting one or more portions of the composite audible signal data; and means for applying the gain function to the composite audible signal data in order to produce directionally filtered audible signal data.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Figure 1:
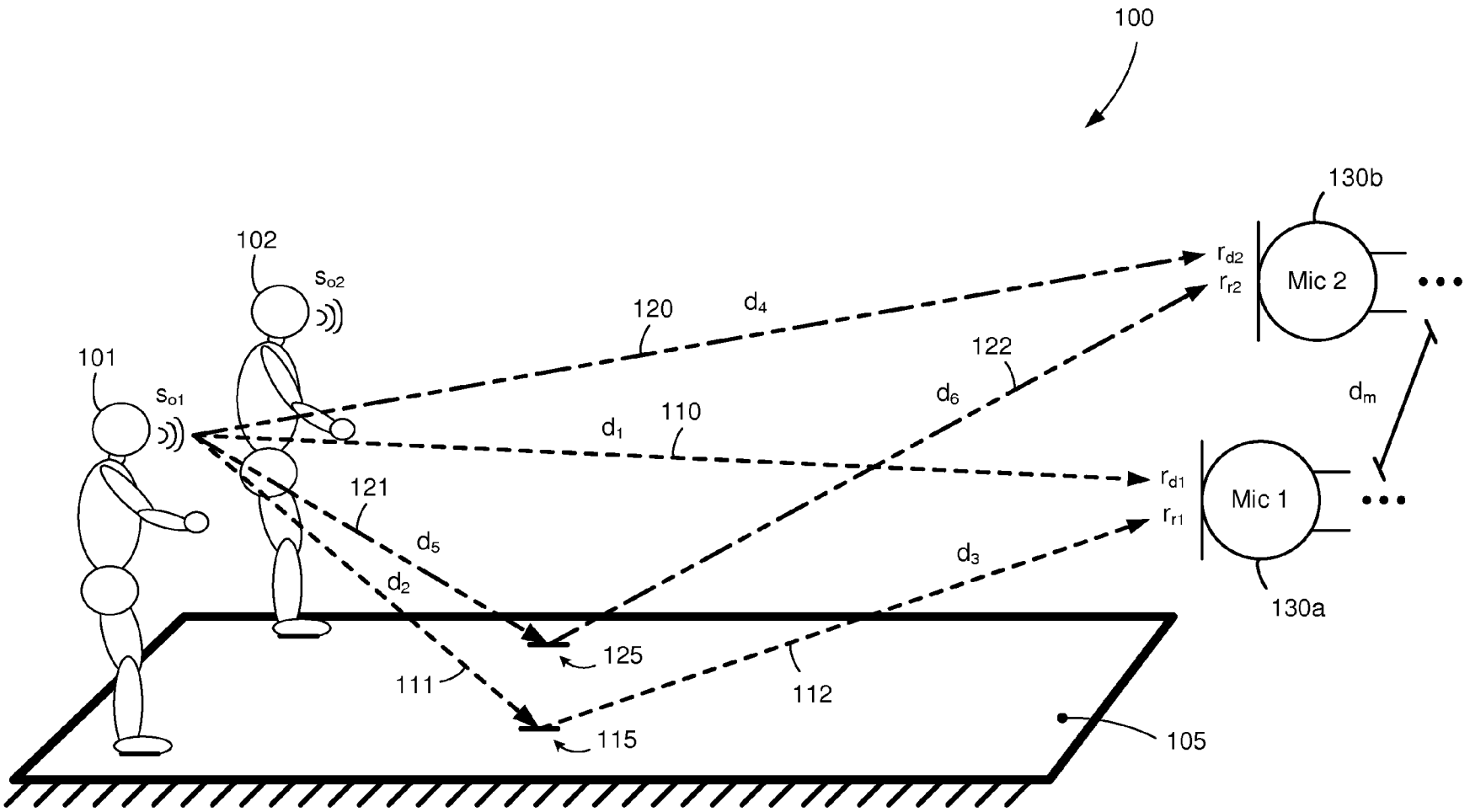
FIG. 1 is a schematic diagram of a simplified example auditory scene in accordance with aspects of some implementations.

In accordance with common practice various features shown in the drawings may not be drawn to scale, as the dimensions of various features may be arbitrarily expanded or reduced for clarity. Moreover, the drawings may not depict all of the aspects and/or variants of a given system, method or apparatus admitted by the specification. Finally, like reference numerals are used to denote like features throughout the drawings.

DETAILED DESCRIPTION

The various implementations described herein include directional filtering of audible signal data, which is provided to enable acoustic isolation and directional localization of a target voice source or other sound sources. Without limitation, various implementations are suitable for speech signal processing applications in, hearing aids, speech recognition and interpretation software, voice-command responsive software and devices, telephony, and various other applications associated with mobile and non-mobile systems and devices.

Numerous details are described herein in order to provide a thorough understanding of the example implementations illustrated in the accompanying drawings. However, the invention may be practiced without many of the specific details. Well-known methods, components, and circuits have not been described in exhaustive detail so as not to unnecessarily obscure more pertinent aspects of the implementations described herein.

Briefly, the approach described herein includes at least one of emphasizing a portion of an audible signal that originates from a target direction and source, and deemphasizing another portion that originates from one or more other directions and sources. In some implementations, directional filtering includes applying a gain function to one or more portions of audible signal data received from two or more audio sensors. In some implementations, the gain function is determined based on a combination of the audible signal data and one or more target values associated with directional cues.

FIG. 1 is a diagram illustrating an example of a simplified auditory scene 100 provided to explain pertinent aspects of various implementations disclosed herein. While pertinent aspects are illustrated, those of ordinary skill in the art will appreciate from the present disclosure that various other features have not been illustrated for the sake of brevity, and so as not to obscure more pertinent aspects of the implementations disclosed herein. To that end, the auditory scene 100 includes a first speaker 101, first and second microphones 130*a*, 130*b*, and a floor surface 105.

The floor surface 105 serves as an example of an acoustic reflector. Those of ordinary skill in the art will appreciate that various relatively closed spaces (e.g., a bedroom, a restaurant, an office, the interior of a vehicle, etc.) have multiple acoustic reflectors that cause reflections that are more closely spaced in time. Those of ordinary skill in the art will also appreciate that in various more expansive spaces (e.g., an open field, a warehouse, etc.) acoustic reflections that are more dispersed in time. The characteristics of the material (e.g., hard vs. soft, surface texture, type, etc.) that an acoustic reflector is made of can impact the amplitude of acoustic reflections off of the acoustic reflector.

The first and second microphones 130*a*, 130*b* are positioned some distance away from the first speaker 101. As shown in FIG. 1, the first and second microphones 130*a*, 130*b* are spatially separated by a distance ($d_m$). In some implementations, the first and second microphones 130*a*, 130*b* are substantially collocated, and are arranged to receive sound from different directions with different intensities. While two microphones are shown in FIG. 1, those of ordinary skill in the art will appreciate from the present disclosure that two or more audio sensors are included in various implementations. In some implementations, at least some of the two or more audio sensors are spatially separated from one another.

In the simplified example shown in FIG. 1, the first speaker 101 provides an audible speech signal $s_{o1}$. Versions of the audible speech signal $s_{o1}$ are received by the first microphone 130*a* along two paths, and by the second microphone 130*b* along two other paths. With respect to the first microphone 130*a*, the first path is a direct path between the first speaker 101 and the first microphone 130*a*, and includes a single path segment 110 of distance $d_1$. The second path is a reverberant path, and includes two segments 111, 112, each having a respective distance $d_2$, $d_3$. Similarly, with respect to the second microphone 130*b*, the first path is a direct path between the first speaker 101 and the second microphone 130*b*, and includes a single path segment 120 of distance $d_4$. The second path is a reverberant path, and includes two segments 121, 122, each having a respective distance $d_5$, $d_6$.

A reverberant path may have two or more segments depending upon the number of reflections the audible signal experiences between a source and an audio sensor. For the sake of providing a simple example, the two reverberant paths shown in FIG. 1 each include merely two segments, which is the result of a respective single reflection off of one of the corresponding points 115, 125 on the floor surface 105. Those of ordinary skill in the art will appreciate that reflections from both points 115, 125 are typically received by both the first and second microphones 130*a*, 130*b*. However, and again merely for the sake of simplicity, FIG. 1 shows that each of the first and second microphones 130*a*, 130*b* receive one reverberant signal. It would also be understood that an acoustic environment often includes two or more reverberant paths between a source and an audio sensor, but only a single reverberant path for each microphone 130*a*, 130*b* has been illustrated for the sake of brevity and simplicity.

With respect to the first microphone 130*a*, the respective signal received along the direct path, namely $r_{d1}$, is referred to as the direct signal. The signal received along the reverberant path, namely $r_{r1}$, is referred to as the reverberant signal. As such, in this simple example, the audible signal received by the first microphone 130*a* is the combination of the direct signal $r_{d1}$ and the reverberant signal $r_{r1}$. Similarly, the audible signal received by the second microphone 130*b* is the combination of a direct signal $r_{d2}$ and a reverberant signal $r_{r2}$.

A distance, $d_n$ (not shown), within which the amplitude of the direct signal (e.g., $|r_d|$) surpasses that of the highest amplitude reverberant signal $|r_r|$ is known as the near-field. Within the near-field the direct-to-reverberant ratio is typically greater than unity as the direct signal dominates the reverberant signal. This is where glottal pulses of the first speaker 101 are prominent in the received audible signal. The near-field distance depends on the size and the acoustic properties of the room and features within the room (e.g., furniture, fixtures, etc.). Typically, but not always, rooms having larger dimensions are characterized by longer cross-over distances, whereas rooms having smaller dimensions are characterized by smaller cross-over distances.

If a second speaker 102 is present (as shown in FIG. 1), the second speaker 102 could provide a competing audible speech signal $s_{o2}$. Versions of the competing audible speech signal $s_{o2}$ would then also be received by the first and second microphones 130*a*, 130*b* along different paths originating from the location of the second speaker 102, and would typically include direct and reverberant signals as described above for the first speaker 101. The signal paths between the second speaker 102 and the first and second microphones 130*a*, 130*b* have not been illustrated in order to preserve the clarity FIG. 1. However, those of ordinary skill in the art would be able to conceptualize the direct and reverberant signal paths from the second speaker 102.

When both the first and second speakers 101, 102 are located in their respective near-fields, the respective direct signal from one of the speakers received at each microphone 130*a*, 130*b* with a greater amplitude will dominate the respective direct signal from the other. The respective direct signal with the lower amplitude may also be heard depending on the relative amplitudes. It is also possible for the direct signal from first speaker 101 to arrive at the first microphone 130*a* with a greater amplitude than the direct signal from the second speaker 102, and for the direct signal from the second speaker 102 to arrive at the second microphone 130*b* with a greater amplitude than the direct signal from the first speaker 101 (and vice versa). In other words, the respective direct signals can arrive with various combinations of amplitudes at each microphone, and the particular direct signal that dominates at one microphone may not dominate at the one or more other microphones. Depending on the situation, one of the two direct signals will be that of the target voice that a human or machine listener is interested in.

Figure 2:
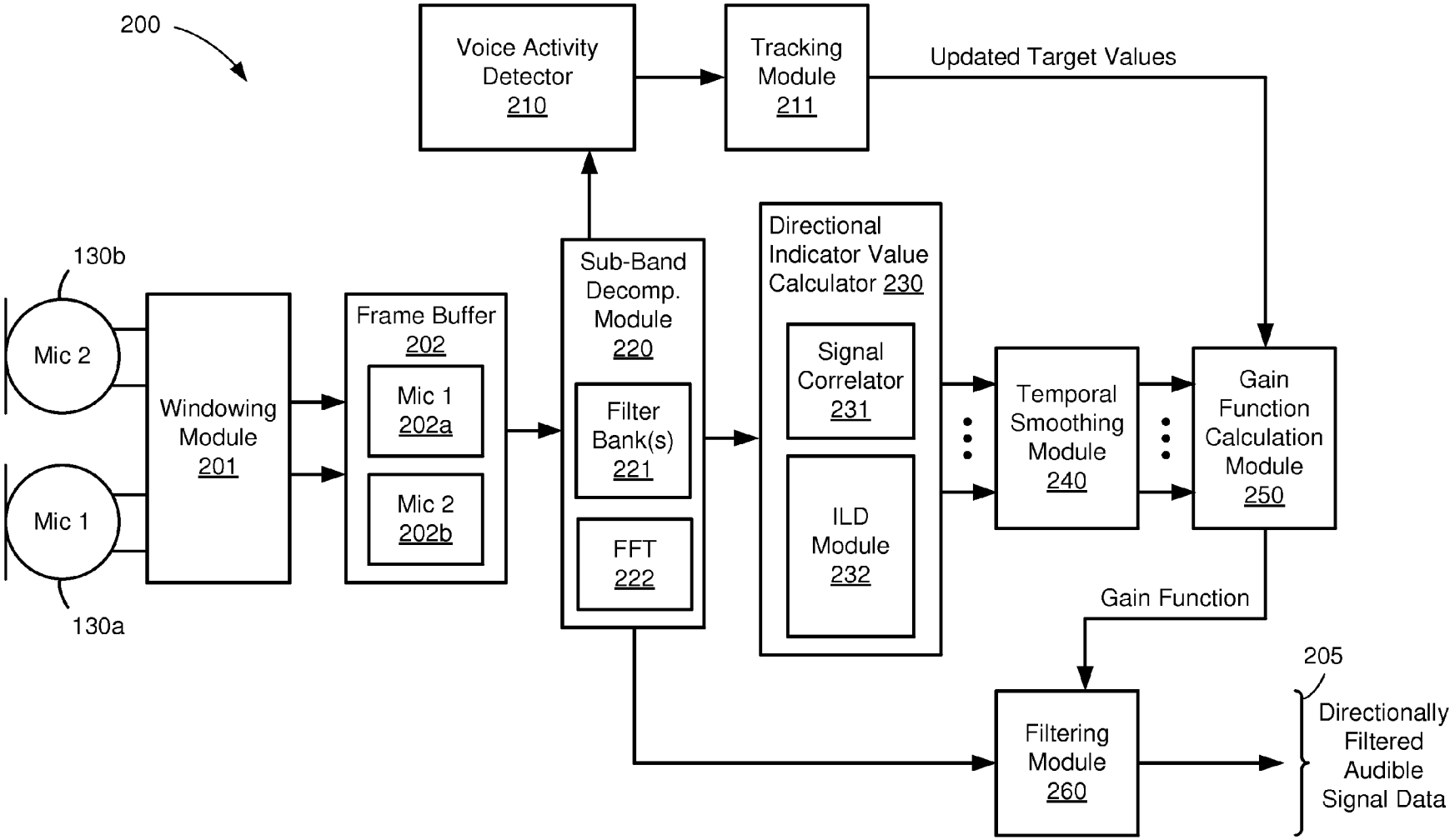
FIG. 2 is a diagram of a directional filtering system in accordance with some implementations.

FIG. 2 is a block diagram of a directional filtering system 200 in accordance with some implementations. While certain specific features are illustrated, those skilled in the art will appreciate from the present disclosure that various other features have not been illustrated for the sake of brevity and so as not to obscure more pertinent aspects of the example implementations disclosed. To that end, as a non-limiting example, in some implementations the directional filtering system 200 includes first and second microphones 130*a*, 130*b*, a windowing module 201, a frame buffer 202, a voice activity detector 210, a tracking module 211, a sub-band decomposition (SBD) module 220, a directional indicator value calculator (DIVC) module 230, a temporal smoothing module 240, a gain function calculation (GFC) module 250, and a filtering module 260.

Briefly, the aforementioned components and modules are coupled together as follows. The first and second microphones 130*a*, 130*b* are coupled to the windowing module 201. The windowing module 201 is coupled to the frame buffer 202. The SBD module 220 is coupled to the frame buffer 202. The SBD module 220 is coupled to the filtering module 260, the DIVC module 230, and the voice activity detector 210. The voice activity detector 210 is coupled to the tracking module 211, which is in turn coupled to GFC module 250. The DIVC module 230 is coupled to the temporal smoothing module 240. The temporal smoothing module 240 is coupled to GFC module 250, which is in turn coupled to the filtering module 260. In operation, the filtering module 260 provides directionally filtered audible signal data from the audible signal data provided by the first and second microphones 130*a*, 130*b*. Those of ordinary skill in the art will appreciate from the present disclosure that the functions of the aforementioned modules can be combined into one or more modules and/or further sub-divided into additional modules. Moreover, the specific couplings and arrangement of the modules are provided as merely one example configuration of the various functions described herein. For example, in some implementations, the voice activity detector 210 is coupled to read audible signal data from the frame buffer 202 in addition to and/or as an alternative to reading decomposed audible signal data from the SBD module 220.

In some implementations, the directional filtering system 200 is configured for utilization in a hearing aid and/or any suitable computer device, such as a computer, a laptop computer, a tablet device, a netbook, an internet kiosk, a personal digital assistant, a mobile phone, a smartphone, a wearable device, a gaming device, and on-board vehicle navigation system. And, as described more fully below, in operation the directional filter 200 emphasizes portions of audible signal data that originate from a particular direction and source, and/or deemphasizes other portions of the audible signal data that originate from one or more other directions and sources.

The first and second microphones 130*a*, 130*b* are provided to receive and convert sound into audible signal data. Each microphone provides a respective audible signal data component, which is an electrical representation of the sound received by the microphone. While two microphones are illustrated in FIG. 2, those of ordinary skill in the art will appreciate that various implementations include two or more audio sensors, which each provide a respective audible signal data component. The respective audible signal data components are included as constituent portions of composite audible signal data from two or more audio sensors. In other words, the composite audible signal data includes data components from each of the two or more audio sensors included in an implementation of a device or system.

In many applications, an audio sensor is configured to output a continuous time series of electrical signal values that does not necessarily have a predefined endpoint. Accordingly, in some implementations, the windowing module 201 is provided to generate discrete temporal frames of the composite audible signal data. In some implementations, the windowing module 201 is configured to obtain the composite audible signal data by receiving the respective audible signal data components from the audio sensors (e.g., the first and second microphones 130*a*, 130*b*). Additionally and/or alternatively, in some implementations, the windowing module 201 is configured to obtain the composite audible signal data by retrieving the composite audible signal data from a non-transitory memory. Temporal frames of the composite audible signal data are stored in the frame buffer 202. In some implementations, the frame buffer 202 includes respective allocations of storage 202*a*, 202*b* for the corresponding audible signal data components provided by the first and second microphones 130*a*, 130*b*. In other words, a frame buffer or the like includes a respective allocation of storage for a corresponding audible signal data component provided by one of a plurality of audio sensors.

Optionally, in some implementations, one or more components of the composite audible signal data are pre-filtered. For example, pre-filtering includes band-pass filtering to isolate and/or emphasize the portion of the frequency spectrum associated with human speech. In some implementations, pre-filtering includes pre-emphasizing portions of one or more temporal frames of the composite audible signal data in order to adjust the spectral composition thereof. In some implementations, a pre-filtering sub-module is included in the windowing module 201. Additionally and/or alternatively, in some implementations, pre-filtering includes filtering the composite audible signal data using a low-noise amplifier (LNA) in order to substantially set a noise floor. In some implementations, a pre-filtering LNA is arranged between the microphones 130*a*, 130*b* and the windowing module 201. Those skilled in the art will appreciate that other pre-filtering methods may be applied to the audible signal data, and the methods discussed above are merely examples of numerous pre-filtering options available.

In some implementations, directional filtering of the composite audible signal data is performed on a sub-band basis in order to filter sounds with more granularity and/or frequency selectivity. Sub-band filtering can be beneficial because different sound sources can dominate at different frequencies. Accordingly, the SBD module 220 is provided to convert one or more audible signal data components into one or more corresponding sets of time-frequency units. The time dimension of each time-frequency unit includes at least one of a plurality of time intervals within a temporal frame. The frequency dimension of each time-frequency unit includes at least one of a plurality of sub-bands contiguously distributed throughout the frequency spectrum associated with the corresponding audible signal data component. In some implementations, the plurality of sub-bands is distributed throughout the frequency spectrum associated with voiced sounds.

In some implementations, the SBD module 220 includes a filter bank 221 and/or an FFT module 222 that is configured to convert each temporal frame of composite audible signal data into two or more sets of time-frequency units. In some implementations, the SBD module 220 includes a gamma-tone filter bank, a wavelet decomposition module, and a bank of one or more interaural intensity difference (IID) filters. In some implementations, the SBD module 220 includes a Short-Form Fourier Transform module followed by the inverse to generate a time-series for each band. In some implementations, a 32 point short-time FFT is used for the conversion. Those of ordinary skill in the art will appreciate that any number of FFT implementations may be used, and that an exhaustive listing of possible implementations has not been provided for the sake of brevity. Additionally and/or alternatively, the FFT module 222 may be replaced with any suitable implementation of one or more low pass filters, such as for example, a bank of IIR filters.

As described below with reference to FIGS. 3, 5 and 7, the DIVC module 230 is configured to determine one or more directional indicator values from the composite audible signal data. To that end, in some implementations, the DIVC module 230 includes a signal correlator module 231 and an inter-microphone level difference (ILD) module 232, each configured to determine a corresponding type of directional indicator value as described below.

In some implementations, the signal correlator module 231 is configured to determine one or more time-based directional indicator values $\{\tau_s\}$ from at least two of the respective audible signal data components. The one or more time-based directional indicator values $\{\tau_s\}$ are representative of a degree of similarity between the respective audible signal data components. For example, in some acoustic environments, the time-series convolution of signals received by the first and second microphones 130*a*, 130*b* provides an indication of the degree of similarity, and thus serves as a directional indicator. In another example, the difference between time-series representations of respective audible signal data components provides an indication of the degree of similarity, and in which case the difference tends to trough in relation to the direction of the sound source. In yet another example, in some acoustic environments, the cross-correlation between signals received by the first and second microphones 130*a*, 130*b* tends to peak proximate to a time-lag value $\tau_n$ that corresponds to the direction of a sound source. Accordingly, determining the one or more time-based directional indicator values includes the following in accordance with some implementations. First, calculating, for each of the one or more time-based directional indicator values, a respective plurality of cross-correlation values $\{\rho(\tau_i)\}$ between two of the respective audible signal data components for a corresponding plurality of time-lag values $\{\tau_i\}$. Second, selecting, for each of the one or more time-based directional indicator values $\{\tau_s\}$, the one of the plurality of time-lag values $\tau_n$ for which the corresponding one of the plurality of cross-correlation values $\rho(\tau_n)$ more closely satisfies a criterion than the other cross-correlation values. In some implementations, calculating each of the one or more time-based directional indicator values $\{\tau_s\}$ includes correspondingly calculating the respective plurality of cross-correlation values $\{\rho(\tau_i)\}$ on a sub-band basis by utilizing corresponding sets of time-frequency units from each of at least one pair of the respective audible signal data components. In other words, each of the one or more time-based directional indicator values $\{\tau_s\}$ is calculated for a particular sub-band by calculating a respective plurality of cross-correlation values $\{\rho(\tau_i)\}$ for each sub-band. In turn, the time-based directional indicator value $\tau_s$ for a particular sub-band includes the time-lag value $\tau_n$ for which the corresponding cross-correlation value $\tau(\tau_n)$ more closely satisfies a criterion than the other cross-correlation values. For example, as provided in equation (1) below, in some implementations, the corresponding time-lag value $\tau_n$ at which the cross-correlation value $\rho(\tau_n)$ is greater than the others is selected as the directional indicator value $\tau_s$ for a particular sub-band:

$$\tau_s = \underset{\tau}{\operatorname{argmax}}\rho(\tau_n) \tag{1}$$

Figure 6:
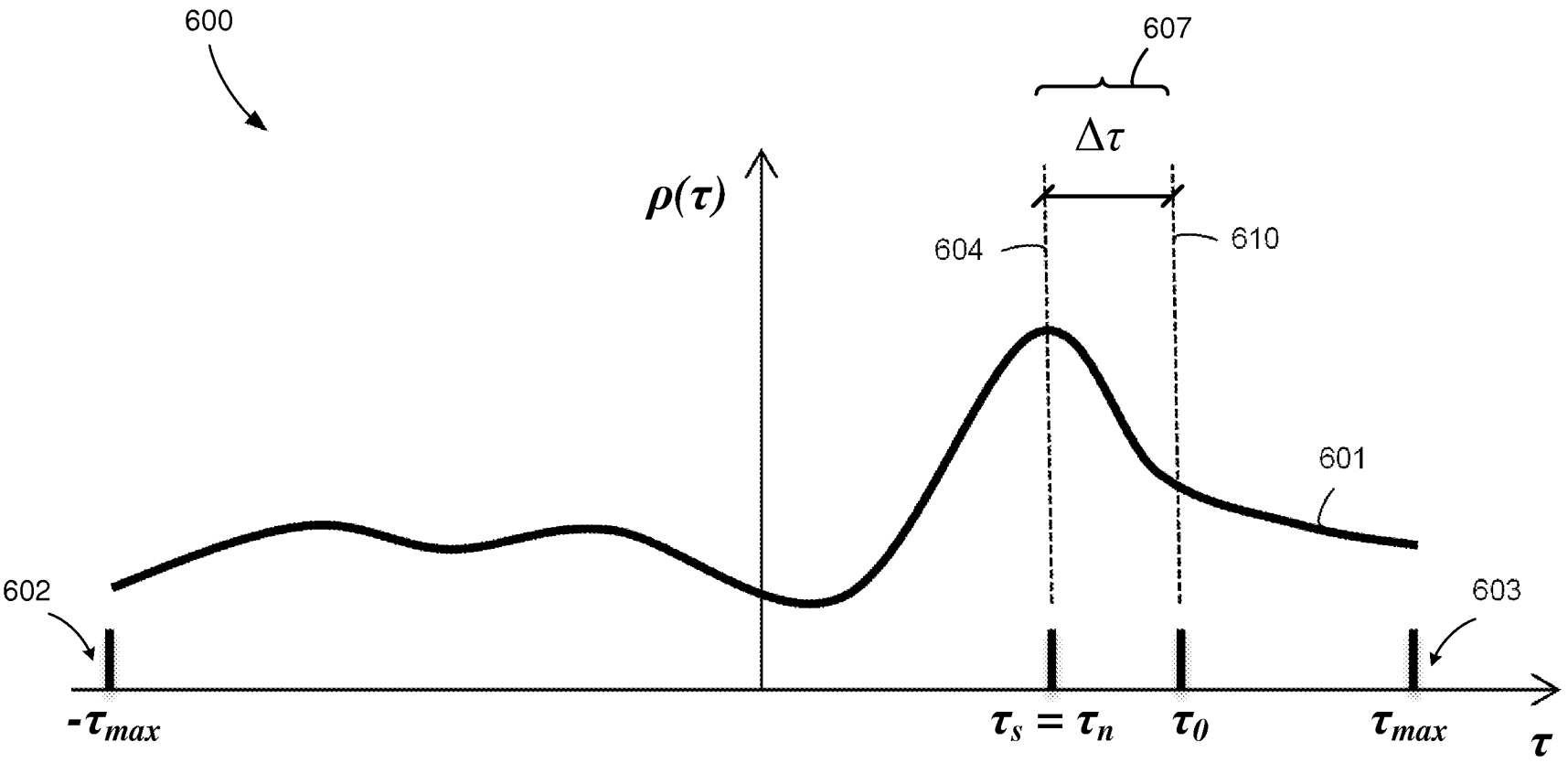
FIG. 6 is a performance diagram showing cross-correlation values determined as a function of various time-lag values in accordance with some implementations.

With continued reference to FIG. 1, FIG. 6 is a performance diagram 600 illustrating cross-correlation values $\{\rho(\tau_i)\}$ 601 determined as a function of various time-lag values $\{\tau_i\}$. More specifically, the cross-correlation values $\{\rho(\tau_i)\}$ 601 are calculated for time-lag values between $-\tau_{max}$ 602 and $\tau_{max}$ 603 (i.e., $-\tau_{max}=\min(\tau_i)$; $\tau_{max}=\max(\tau_i)$); $\tau_i \epsilon T=\{-\tau_{max} \rightarrow \tau_{max}\}$). The time-lag value $\tau_n$ 604 at which the cross-correlation value $\rho(\tau_n)$ is greater than the others (or closest to a peak cross-correlation value of those calculated) corresponds to the direction of a sound source, and is thus selected as the time-based directional indicator value $\tau_s$ for the sub-band.

Moreover, while equation (1) uses the peak cross-correlation value as a suitable criterion, those of ordinary skill in the art will appreciate that other criteria may also be used. For example, in some implementation, the time-based directional indicator value $\tau_s$ is the time-lag value $\tau_n$ that results in distinguishable cross-correlation values across a number of sub-bands. In a more specific example, in some implementations, the time-based directional indicator value $\tau_s$ is the time-lag value $\tau_n$ that results in the largest cross-correlation value across the largest number of sub-bands.

In some implementations, the ILD module 232 is configured to determine one or more power-based directional indicator values $\{\delta_s\}$ from at least two of the respective audible signal data components. Returning to the present example, each of the one or more power-based directional indicator values $\{\delta_s\}$ is a function of a level difference value between a pair of audible signal data components. In some implementations, the level difference value provides an indicator of relative signal powers characterizing the pair of the respective audible signal data components. As describe below with respect to FIG. 7, in some implementations, calculating the respective level difference values includes calculating the respective level difference values on a sub-band basis by utilizing corresponding sets of time-frequency units from each of at least one pair of the respective audible signal data components. Additionally and/or alternatively, in various implementations, average and/or peak amplitude-based directional indicator values are used. Additionally and/or alternatively, in various implementations, average and/or peak energy-based directional indicator values are used.

Figure 9:
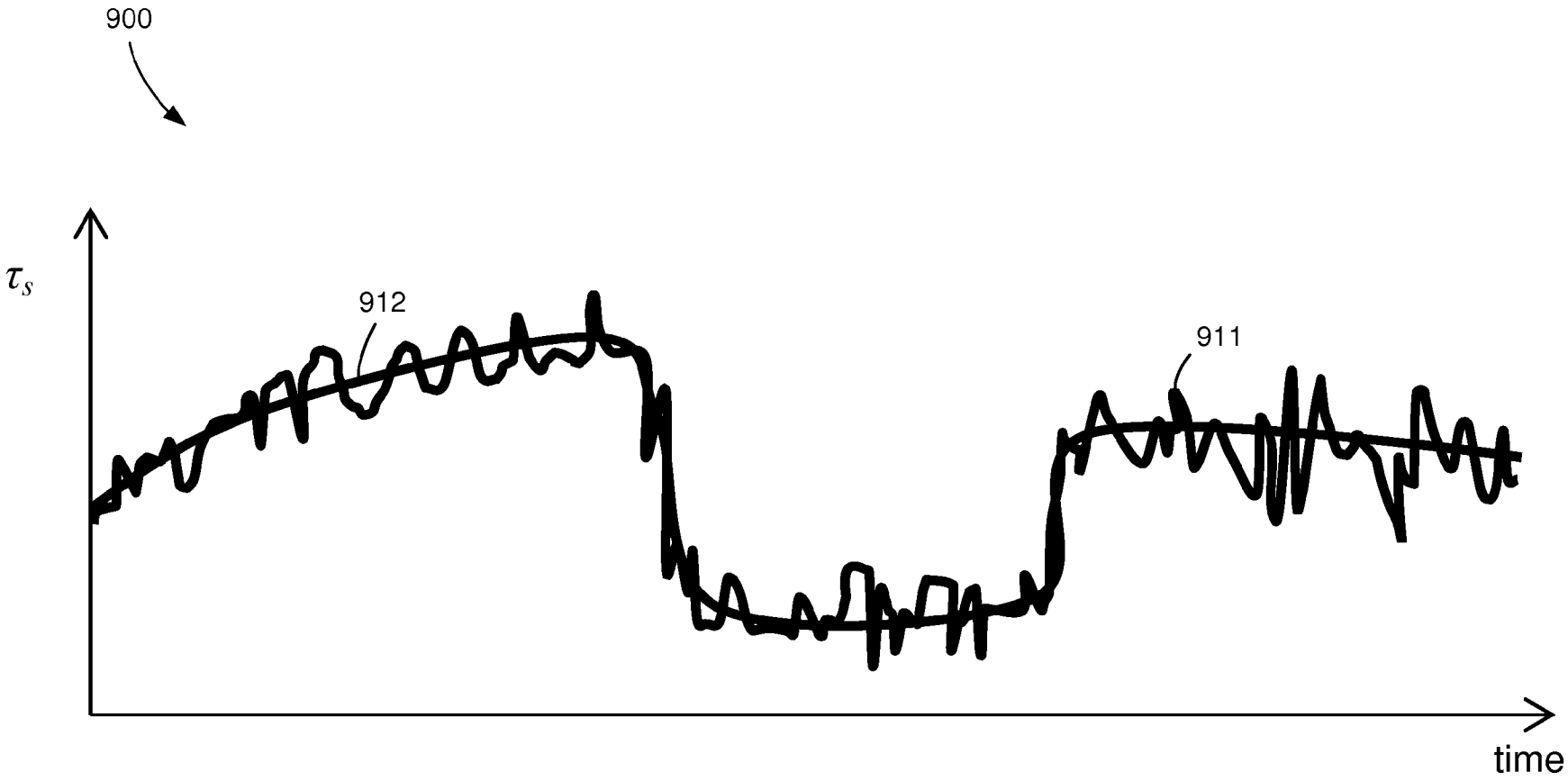
FIG. 9 is a performance diagram showing temporal smoothing of a directional indicator value in accordance with some implementations.

The temporal smoothing module 240 is provided to optionally decrease a respective time variance value associated with a particular directional indicator value. For example, FIG. 9 is a performance diagram 900 illustrating temporal smoothing of the time-based directional indicator value $\tau_s$. More specifically, FIG. 9 shows the raw (or temporally unsmoothed) values (i.e., jagged line 911) of the time-based directional indicator value Ts, and the temporally smoothed values (i.e., smooth line 912) of the time-based directional indicator value $\tau_s$. Temporal smoothing (or decreasing the respective time variance value) of the time-based directional indicator value $\tau_s$ can be done in several ways. For example, in various implementations, decreasing the respective time variance value includes filtering the at least one of the one or more directional indicator values using at least one of a low pass filter, a running median filter, a Kalman filter and a leaky integrator. Moreover, while FIG. 9 shows an example of temporal smoothing associated with a time-based directional indicator value Ts, those of ordinary skill in the art will appreciate that temporal smoothing can be utilized for any type of directional indicator value.

Returning to FIG. 2, the GFC module 250 is configured to determine a gain function G from the one or more directional indicator values produced by the DIVC 230 (or, optionally the temporal smoothing module 240). The gain function G targets one or more portions of the composite audible signal data. In some implementations, the gain function G is generated to target one or more portions of the composite audible signal data that include audible signal data from a target source (e.g., the first speaker 101, shown in FIG. 1). In some implementations, the gain function G is determined to target one or more portions of the composite audible signal data that include audible voice activity from a target source.

In some implementations, a gain function is determined on a sub-band basis, so that one or more sub-bands utilize a gain function G that is determined from different frequency-dependent values as compared to at least one other sub-band. Additionally and/or alternatively, in some implementations, generating the gain function G from the one or more directional indicator values includes determining, for each directional indicator value type, a respective component-gain function between the directional indicator value and a corresponding target value associated with the directional indicator value type. In some implementations, a respective component-gain function includes a distance function of the directional indicator value and the corresponding target value. In some implementations, a distance function includes an exponential function of the difference between the directional indicator value and the corresponding target value.

For example, in some implementations, a gain function G is a function of a time-based directional indicator value $\tau_s$ and/or a power-based directional indicator value $\delta_s$. FIG. 6 graphically shows the difference $\Delta\tau$ 607 between the target value $\tau_0$ 610 and the time-lag value $\tau_n$ selected as the time-based directional indicator value $\tau_s$, as described above. Referring to equations (2) and (3), determining the gain function includes determining an exponential function of the difference between the directional indicator value and the corresponding target value:

$$\Delta\tau=|\tau_s-\tau_0|^n \tag{2}$$

$$\Delta\delta=|\delta_s-\delta_0|^n \tag{3}$$

where, $\tau_0$ is a target value associated with the time-based directional indicator value $\tau_s$, and $\delta_0$ is a target value associated with the power-based directional indicator value $\delta_s$. The exponent n provides a further spatial characterization. For example, n=1 corresponds to the so-called "city-block distance" in auditory signal processing, or L1 norm; and, n=2 corresponds to the Euclidian distance, or L2 norm. Other values for n are also possible, including non-integer values. In some implementations, a signal portion in a sub-band is attenuated to a greater extent the further away one or more of the determined directional indicator values ($\tau_s$, $\delta_s$) are from the respective target values ($\tau_0$, $\delta_0$). Additionally and/or alternatively, in some implementations, a signal portion in a sub-band is emphasized to a greater extent the closer one or more of the determined directional indicator values ($\tau_s$, $\delta_s$) are to the respective target values ($\tau_0$, $\delta_0$).

In some implementations, each of the component-gain functions $G_\tau$, $G_\delta$ is calculated by determining a sigmoid function of the corresponding distance function. Various sigmoid functions may be used, such as a logistic function or a hyperbolic tangent function. For example, as provided by equations (4) and (5), the component-gain functions $G_\tau$; $G_\delta$ are determined as follows:

$$G_\tau = S(a_\tau \Delta\tau - b_\tau) \tag{4}$$

$$G_\delta = S(a_\delta \Delta\delta - b_\delta) \tag{5}$$

where $a_\tau$, $a_\delta$ are steepness coefficients, and $b_\tau$, $b_\delta$ are shift values. The steepness coefficients $a_\tau$, $a_\delta$ and shift values $b_\tau$, $b_\delta$ are adjusted to satisfy objective or subjective quality measures, such as overall signal-to-noise ratio, spectral distortion, mean opinion score, intelligibility, and/or speech recognition scores.

In some implementations, the component-gain functions (e.g., $G_\tau$, $G_\delta$) are applied individually to one or more portions of the composite audible signal data. In some implementations, two or more component-gain functions $G_\tau$, $G_\delta$ are combined to produce the gain function G applied to the sub-band signals. For example, as provided by equation (6), the two component gain functions $G_\tau$, $G_\delta$ are multiplied together to produce the gain function G:

$$G = G_\tau G_\delta \tag{6}$$

In another example, as provided by equation (7), the gain function G is a weighted summation the two component gain functions $G_\tau$, $G_\delta$:

$$G = \beta G_\tau + (1-\beta) G_\delta \tag{7}$$

where $\beta$ is a mixing ratio in the interval [0,1].

The filtering module 260 is configured to adjust the spectral composition of the composite audible signal data using the gain function G (or, one or more of the component-gain functions individually or in combination) in order to produce directionally filtered audible signal data 205. The directionally filtered audible signal data 205 includes one or more portions of the composite audible signal data that have been modified by the gain function G. For example, in some implementations, the filtering module 260 is configured to one of emphasize, deemphasize, and isolate one or more components of a temporal frame of composite audible signal data. More specifically, in some implementations, filtering the composite audible signal data includes applying the gain function G to one or more time-frequency units of the composite audible signal data.

The voice activity detector 210 is configured to detect the presence of a voice signal in the composite audible signal data, and provide a voice activity indicator based on whether or not a voice signal is detected. As shown in FIG. 2, the voice activity detector 210 is configured to perform voice signal detection on a sub-band basis. In other words, the voice activity detector 210 assesses one or more sub-bands associated with the composite audible signal data in order to determine if the one or more sub-bands include the presence of a voice signal. The voice activity detector 210 can be implemented in a number of different ways. For example, U.S. application Ser. No. 13/590,022 to Zakarauskas et al. and Ser. No. 14/099,892 to Anharii et al. provide detailed examples of various types of voice activity detection systems, methods and devices that could be utilized in various implementations. For brevity, an exhaustive review of the various types of voice activity detection systems, methods and apparatuses is not provided herein.

The tracking module 211 is configured to adjust one or more of the respective target values ($\tau_0$, $\delta_0$) based on an indicator provided by the voice activity detector 210. A target speaker or sound source is not always situated in the expected location/direction. As such, in some implementations, one or more of the target values ($\tau_0$, $\delta_0$) are adjusted to track the actual directional cues the target speaker without substantially tracking background noise and other types of interference. As shown in FIG. 2, this discrimination is done with the help of the voice activity detector 210. When the voice activity detector 210 detects the presence of a voice signal in a portion of the composite audible signal data, one or more of the target values ($\tau_0$, $\delta_0$) are adjusted in response by the tracking module 211.

Figure 10:
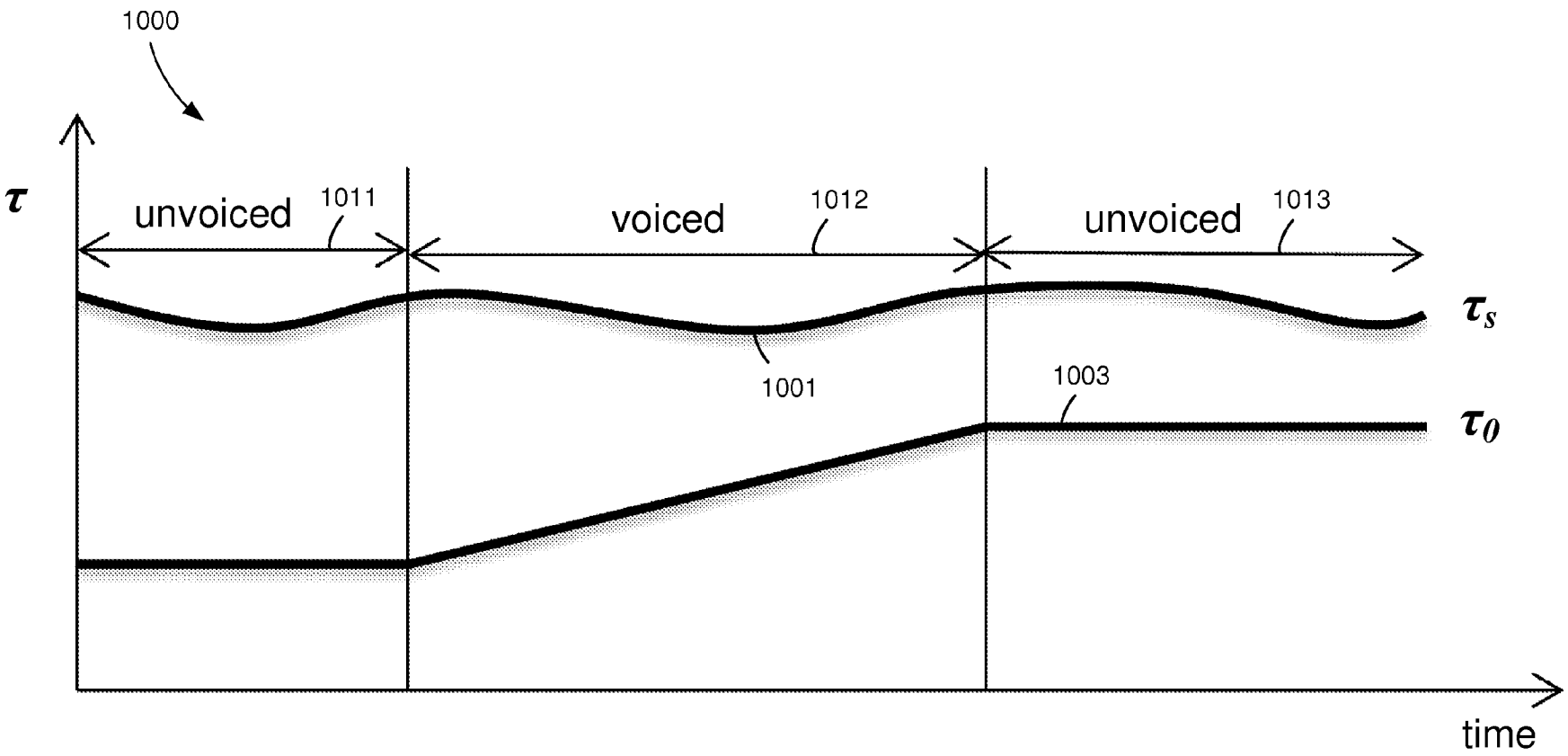
FIG. 10 is a performance diagram illustrating temporal tracking of a target value associated with a directional indicator value in accordance with some implementations.

For example, FIG. 10 is a performance diagram 1000 illustrating temporal tracking of a target value $\tau_0$ associated with the time-based directional indicator value $\tau_s$ in accordance with some implementations. The performance diagram 1000 includes first, second and third time segments 1011, 1012 and 1013, respectively. The first and third time segments 1011, 1013 do not include speech signals. As such, the target value $\tau_0$ does not change relative to the time-based directional indicator value $\tau_s$ in the first and third segments 1011, 1013. However, the second segment 1012 includes a voice signal, and in turn, the target value $\tau_0$ changes relative to the time-based directional indicator value $\tau_s$. In the example shown, the target value $\tau_0$ is moved closer to the time-based directional indicator value $\tau_s$ throughout the second segment 1012 including the voice signal.

In some implementations, a tracking process includes detecting the presence of voice activity in at least one of the respective audible signal data components; and, adjusting the corresponding target value ($\tau_0$, $\delta_0$) in response to the detection of the voice activity. In some implementations, a tracking process includes detecting a change of voice activity between at least two of the respective audible signal data components; and, adjusting the corresponding target value ($\tau_0$, $\delta_0$) in response to the detection of the change of voice activity.

Figure 3:
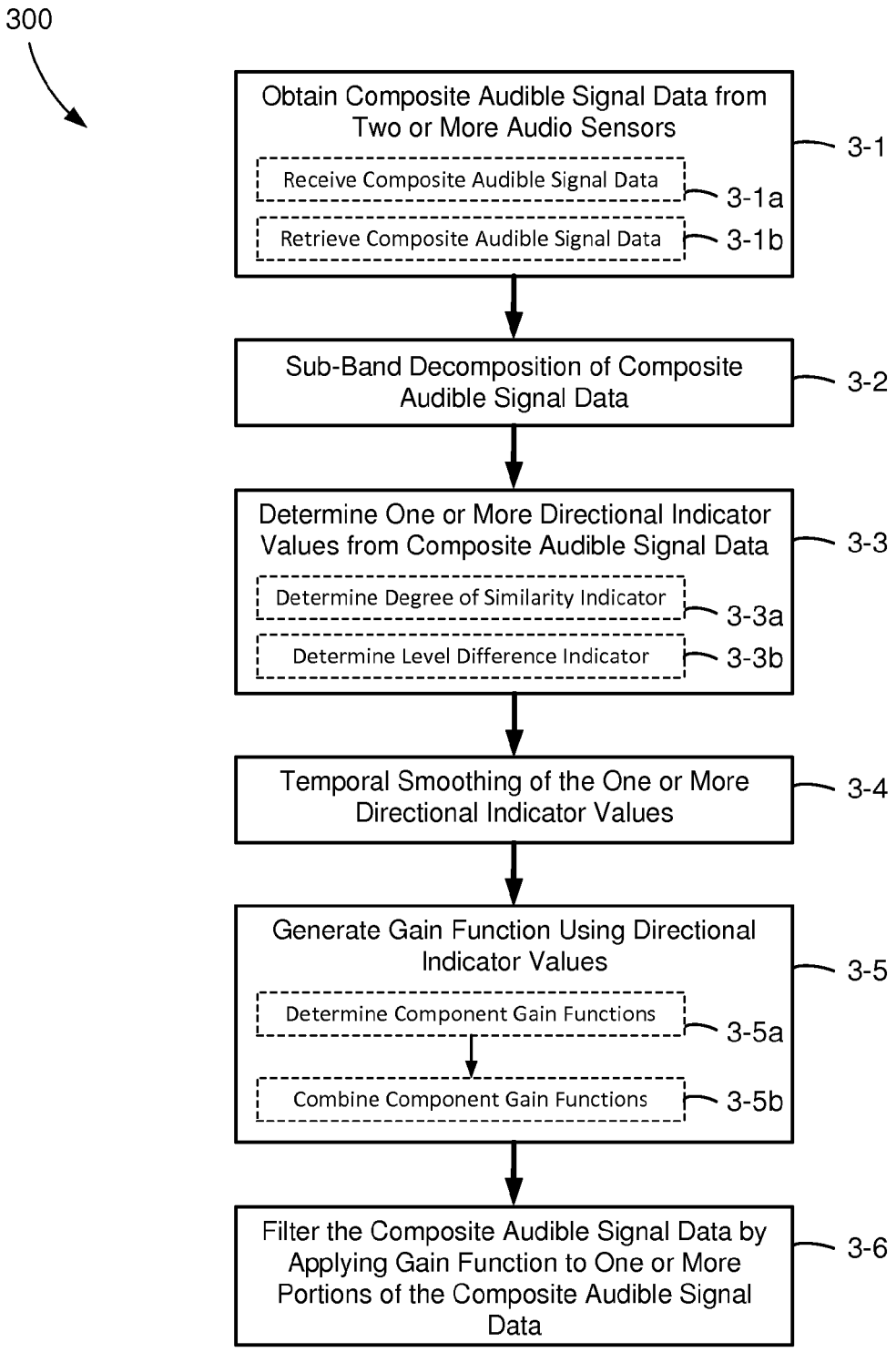
FIG. 3 is a flowchart representation of a method of directionally filtering audible signal data using directional auditory cues in accordance with some implementations.
Figure 4:
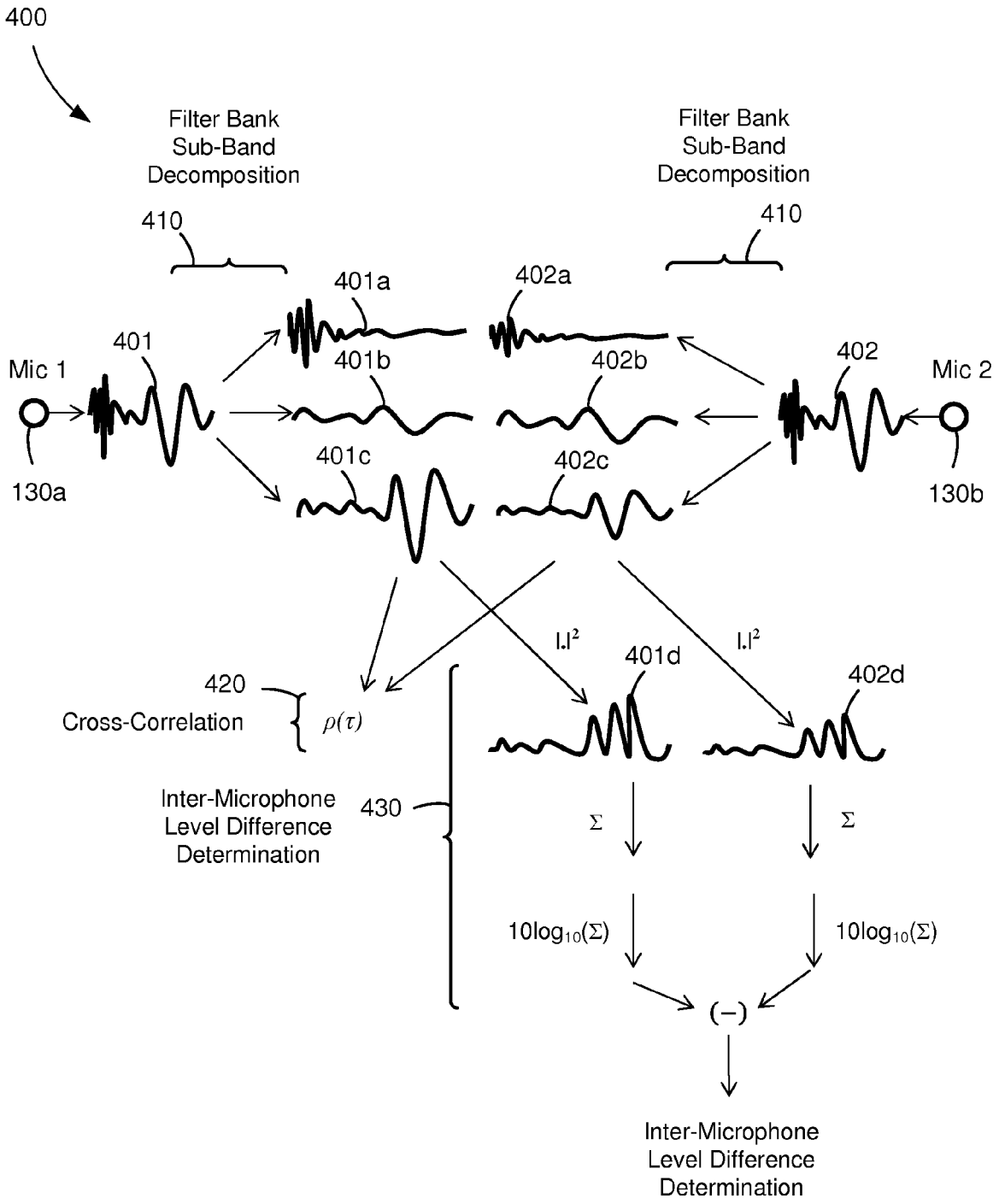
FIG. 4 is a signal-flow diagram showing portions of a method of determining directional indicators values from audible signal data according to some implementations.

FIG. 3 a flowchart representation of a method 300 of filtering audible signal data using directional auditory cues from audible signal data according to some implementations. Additionally, FIG. 4 is a signal-flow diagram 400 illustrating example signals at portions of the method 300. In some implementations, the method 300 is performed by a directional filtering system in order to emphasize a portion of an audible signal that originates from a particular direction and source, and deemphasize another portion that originates from one or more other directions and sources. Briefly, the method 300 includes filtering composite audible signal data using a gain function determined from one or more directional indicator values derived from the composite audible signal data.

To that end, as represented by block 3-1, the method 300 includes obtaining composite audible signal data from two or more audio sensors, where the composite audible signal data includes a respective audible signal data component from each of the two or more audio sensors. In some implementations, as represented by block 3-1*a*, obtaining the composite audible signal data includes receiving the respective audible signal data components from the two or more audio sensors. For example, with reference to FIG. 4, the first and second microphones 130*a*, 130*b* provide respective audible signal data components 401, 402. In some implementations, as represented by block 3-1*b*, obtaining the composite audible signal data includes retrieving the composite audible signal data from a non-transitory memory. For example, one or more of the respective audible signal data components is stored in a non-transitory memory after being received by two or more audio sensors.

As represented by block 3-2, the method 300 includes sub-band decomposition of the composite audible signal data. In other words, the method 300 includes converting the composite audible signal data into a plurality of time-frequency units. The time dimension of each time-frequency unit includes at least one of a plurality of time intervals within a temporal frame. The frequency dimension of each time-frequency unit includes at least one of a plurality of sub-bands contiguously distributed throughout the frequency spectrum associated with the corresponding audible signal data component. In some implementations, the plurality of sub-bands is distributed throughout the frequency spectrum associated with voiced sounds. In some implementations, converting the composite audible signal data into the plurality of time-frequency units includes individually converting some of the respective audible signal data components into corresponding sets of time-frequency units included in the plurality of time-frequency units.

For example, with reference to FIG. 4, sub-band de-composition indicated by 410 is performed by filter banks on the respective audible signal data components 401, 402 in order to produce corresponding sets of time-frequency units {401*a*, 401*b*, 401*c*} and {402*a*, 402*b*, 402*c*}. In some implementations, converting the composite audible signal data into the plurality of time-frequency units includes: dividing a respective frequency domain representation of each of one or more of the respective audible signal data components into a plurality of sub-band data units; and, generating a respective time-series representation of each of the plurality of sub-band data units, each respective time-series representation comprising a time-frequency unit. In some implementations, sub-band decomposition also includes generating the respective frequency domain representation of each of the one or more of the respective audible signal data components by utilizing one of a gamma-tone filter bank, a short-time Fourier transform, a wavelet decomposition module, and a bank of one or more interaural intensity difference (IID) filters.

As represented by block 3-3, the method 300 includes determining one or more directional indicator values from composite audible signal data. As represented by block 3-3*a*, in some implementations, the method 300 includes determining a directional indicator value that is representative of a degree of similarity between the respective audible signal data components, such as the time-based directional indicator value $\tau_s$ discussed above. A method of determining time-based directional indicator values $\{\tau_s\}$ is also described below with reference to FIG. 5. For example, with reference to FIG. 4, cross-correlation values $\{\rho(\tau_i)\}$ 420 are calculated in order to determine time-based directional indicator values $\{\tau_s\}$ for respective sub-bands. As represented by block 3-3*b*, in some implementations, determining a directional indicator value that is a function of a respective level difference value for each of at least one pair of the respective audible signal data components, such as the power-based directional indicator value $\delta_s$ discussed above. For example, with reference to FIG. 4, power-levels 430 are calculated in order to determine power-based directional indicator values $\{\delta_s\}$ for respective sub-bands. A method of determining power-based directional indicator values $\{\delta_s\}$ is also described below with reference to FIG. 7.

As represented by block 3-4, the method 300 includes temporal smoothing of one or more of the directional indicator values in order to decrease a respective time variance value associated with a directional indicator value. As noted above, temporal smoothing (or decreasing the respective time variance value) of a directional indicator value can be done in several ways. For example, in various implementations, decreasing the respective time variance value includes filtering the at least one of the one or more directional indicator values using at least one of a low pass filter, a running median filter, a Kalman filter and a leaky integrator.

As represented by block 3-5, the method 300 includes generating a gain function G using one or more directional indicator values. In some implementations, as represented by block 3-5*a*, generating the gain function G includes determining one or more component-gain functions. For example, a discussed above with reference to FIG. 2, component-gain functions $G_\tau$, $G_\delta$ are determined for the corresponding directional indicator values ($\tau_s$, $\delta_s$). In some implementations, a gain function is determined on a sub-band basis, so that one or more sub-bands utilize a gain function G that is determined from different frequency-dependent values as compared to at least one other sub-band.

Figure 8A:
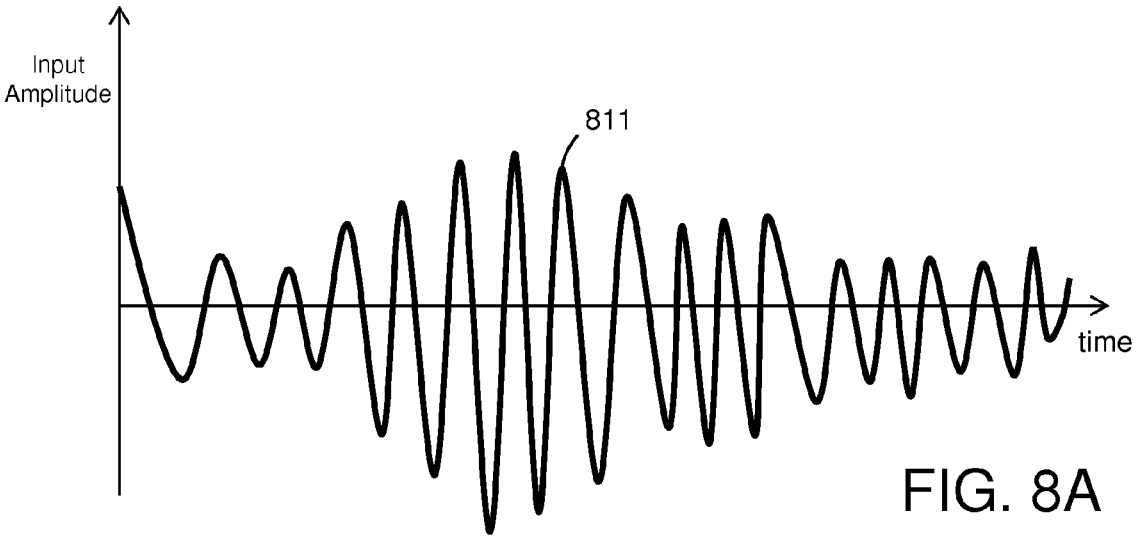
FIGS. 8A, 8B and 8C are signal diagrams illustrating the filtering effect a directional filter has on audible signal data in accordance with some implementations.
Figure 8B:
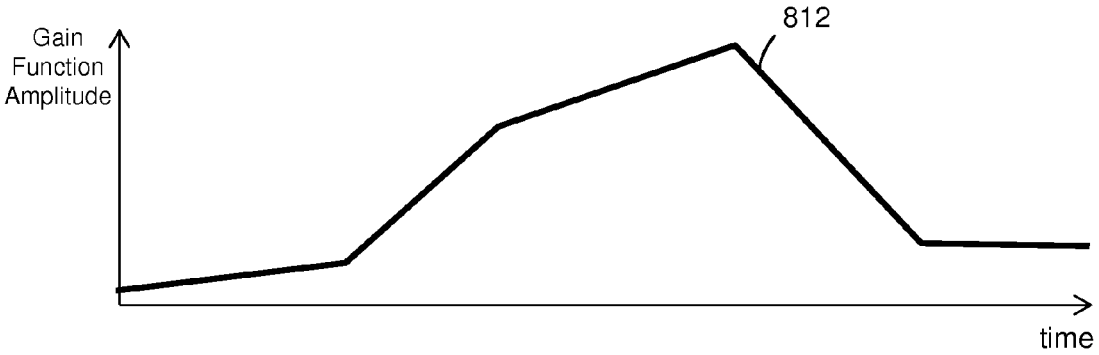
Figure 8C:
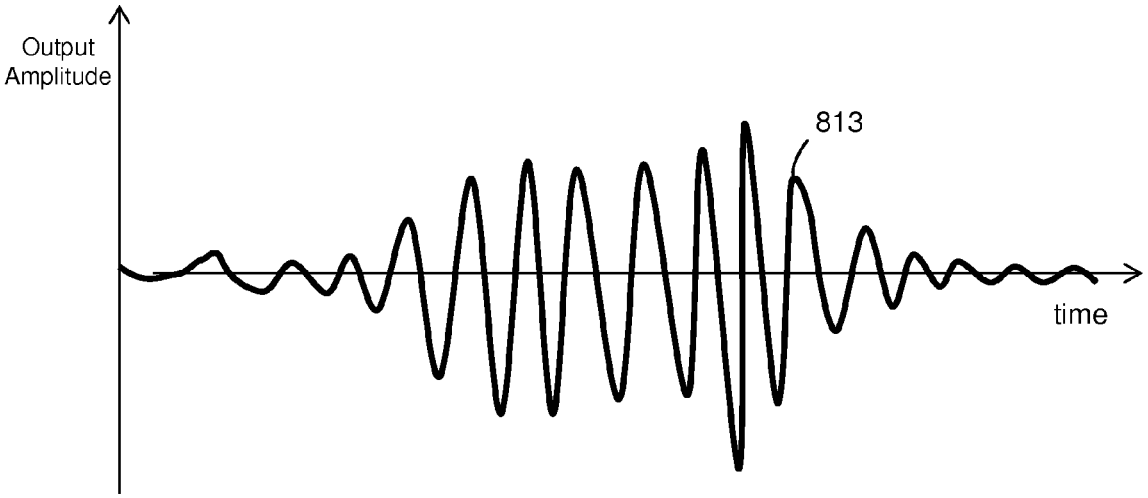

As represented by block 3-6, the method 300 includes filtering the composite audible signal data by applying the gain function to one or more portions of the composite audible signal data. For example, in some implementations, filtering occurs on a sub-band basis such that a sub-band dependent gain function is applied to one or more time-frequency units of the composite audible signal data. As an illustrative example, FIGS. 8A, 8B and 8C are signal diagrams illustrating the filtering effect a directional filter has on audible signal data in accordance with some implementations. FIG. 8A, for example, shows a time-series representation of audible signal data 811 for a sub-band. FIG. 8B shows an example of a time-series representation of a gain function G 812 to be applied to the time-series representation of the audible signal data 811. In turn, FIG. 8B shows the resulting time-series representation of the filtered audible signal data 813 in the respective sub-band after the gain function G 812 has been applied to the audible signal data 811.

Figure 5:
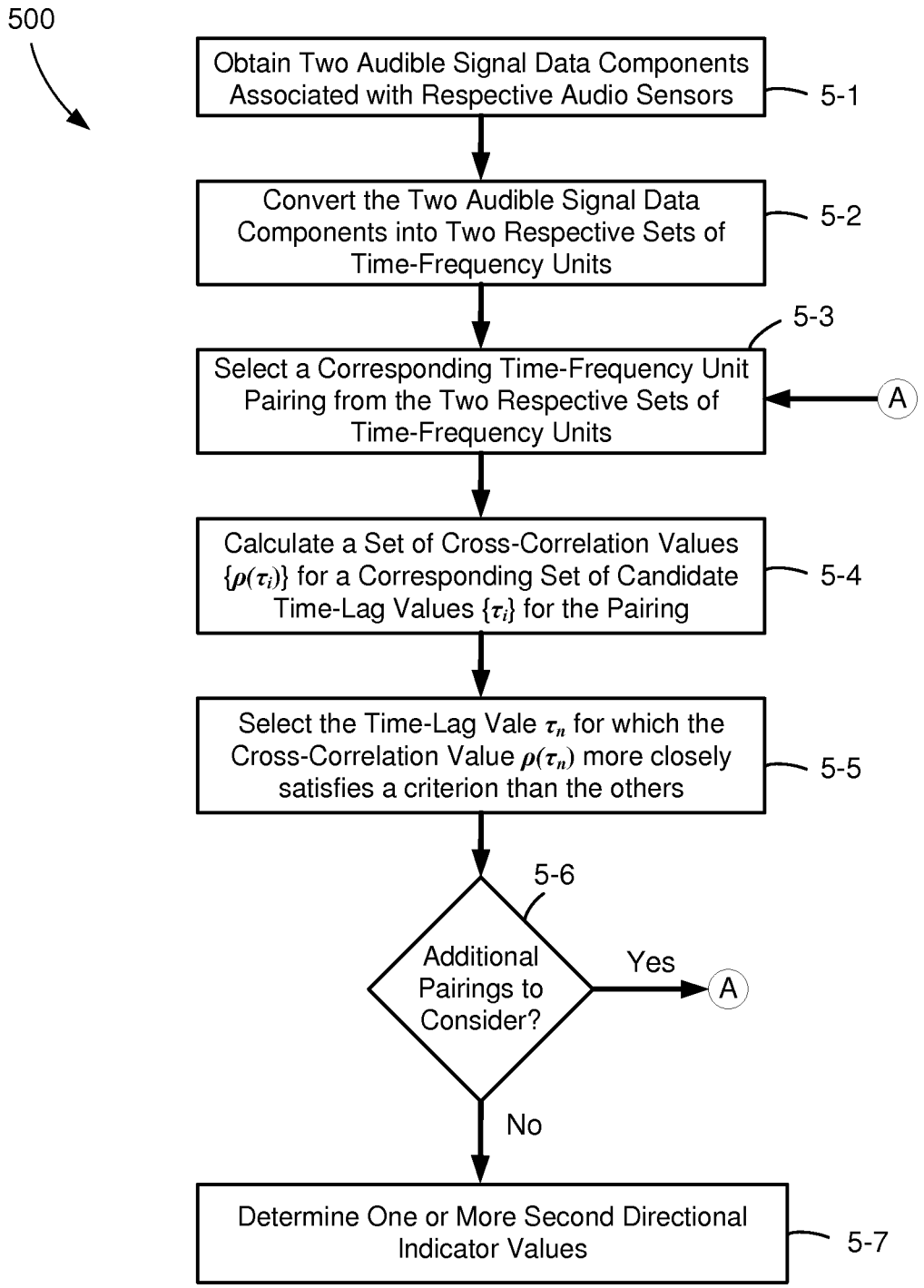
FIG. 5 is flowchart representation of a method of determining one or more time-based directional indicator values in accordance with some implementations.

FIG. 5 is flowchart representation of a method 500 of determining one or more time-based directional indicator values $\{\tau_s\}$ on a sub-band basis in accordance with some implementations. In some implementations, the method 500 is performed by a directional indicator value calculator module and/or a component thereof (e.g., signal correlator module 231 of FIG. 2). Briefly, the method 500 includes calculating cross-correlation values $\{\tau(\tau_i)\}$ for each sub-band, and selecting the time-lag value $\tau_n$ for which the corresponding cross-correlation value $\rho(\tau_n)$ more closely satisfies a criterion than the other cross-correlation values.

To that end, as represented by block 5-1, the method 500 includes obtaining two respective audible signal data components associated with corresponding audio sensors. As represented by block 5-2, the method 500 includes converting the two respective audible signal data components into two corresponding sets of time-frequency units. As represented by block 5-3, the method 500 includes selecting a time-frequency unit pairing from the two sets of time-frequency units, such that one time-frequency unit is selected from each set. Moreover, the selected pairing includes overlapping temporal and frequency portions of the respective audible signal data components. As represented by block 5-4, the method 500 includes calculating cross-correlation values $\{\rho(\tau_i)\}$ for a corresponding plurality of time-lag values $\{\tau_i\}$. For example, as described above with reference to FIG. 6, the cross-correlation values $\{\rho(\tau_i)\}$ 601 are calculated for time-lag values between $-\tau_{max}$ 602 and $\tau_{max}$ 603 (i.e., $-\tau_{max}=\min(\tau_i)$; $\tau_{max}=\max(\tau_i)$); $\tau_i \epsilon T=\{-\tau_{max} \rightarrow \tau_{max}\}$). As represented by block 5-5, the method 500 includes selecting, as the time-based directional indicator value $\tau_s$ for the current sub-band, the time-lag value $\tau_n$ for which the corresponding cross-correlation value $\rho(\tau_n)$ more closely satisfies a criterion than the other cross-correlation values.

As represented by block 5-6, the method 500 includes determining whether or not there are additional time-frequency unit pairings (corresponding to other sub-bands) remaining to consider. If there are additional time-frequency unit pairings remaining to consider ("Yes" path from block 5-6), the method circles back to the portion of the method represented by block 5-3. If there are not additional time-frequency unit pairings remaining to consider ("No" path from block 5-6), as represented by block 5-7, the method 500 includes determining one or more second directional indicator values from the at least two of the respective audible signal data components used to determine the time-based directional indicator values $\{\tau_s\}$, the one or more second directional indicator values are representative of a level difference between the respective audible signal data components.

Figure 7:
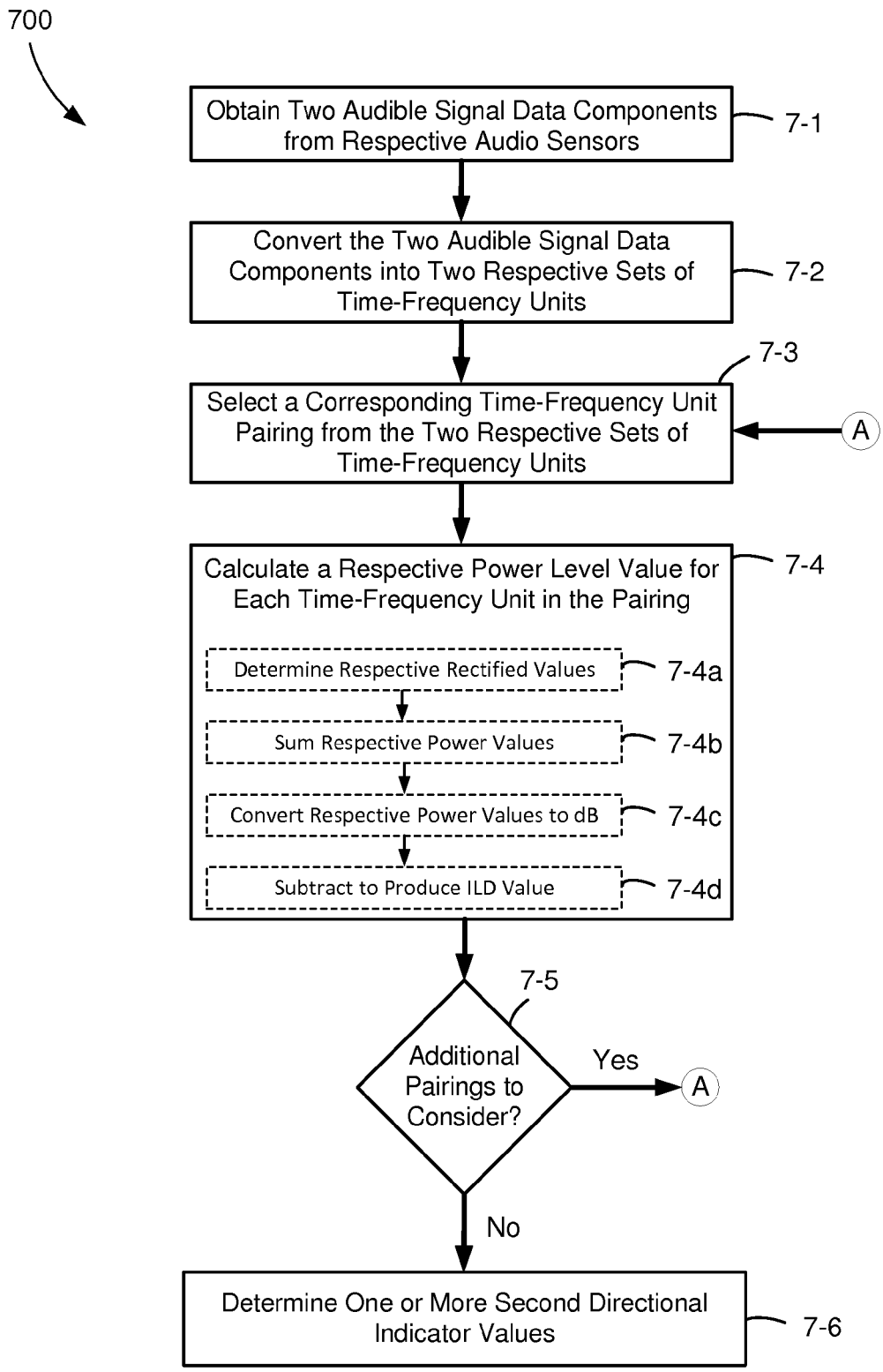
FIG. 7 is flowchart representation of a method of obtaining inter-microphone level difference (ILD) values in accordance with some implementations.

FIG. 7 is flowchart representation of a method 700 of determining one or more power-based directional indicator values $\{\delta_s\}$ on a sub-band basis in accordance with some implementations. In some implementations, the method 500 is performed by a directional indicator value calculator module and/or a component thereof (e.g., the ILD module 232 of FIG. 2). Briefly, the method 700 includes determining power-based directional indicator values $\{\delta_s\}$ by calculating respective level difference values on a sub-band basis by utilizing corresponding sets of time-frequency units from each of at least one pair of the respective audible signal data components.

To that end, as represented by block 7-1, the method 700 includes obtaining two respective audible signal data components associated with corresponding audio sensors. In some implementations, the two respective audible signal data components are also used to determine associated time-based directional indicator values $\{\tau_s\}$, as for example, described above. As represented by block 7-2, the method 700 includes converting the two respective audible signal data components into two corresponding sets of time-frequency units. As represented by block 7-3, the method 700 includes selecting a time-frequency unit pairing from the two sets of time-frequency units, such that one time-frequency unit is selected from each set. Moreover, the selected pairing includes overlapping temporal and frequency portions of the respective audible signal data components.

As represented by block 7-4, the method 700 includes calculating a respective power-based directional indicator value $\delta_s$ for the sub-band time-frequency unit pairing. As represented by block 7-4*a*, calculating the respective power-based directional indicator value $\delta_s$ includes determining the corresponding rectified values for each time-frequency unit. For example, as shown in FIG. 4, rectified values 401*d*, 402*d* are calculated from the corresponding time-frequency units 401*c*, 402*c*. As represented by block 7-4*b*, calculating the respective power-based directional indicator value $\delta_s$ includes summing the respective power value. For example, as shown in FIG. 4, the rectified values are individually summed to produce power values. As represented by block 7-4*c*, calculating the respective power-based directional indicator value $\delta_s$ includes converting the power values into corresponding decibel (dB) power values (indicated by $10 \log_{10}$ ($\Sigma$) in FIG. 4). As represented by block 7-4*c* (and the subtraction sign in FIG. 4), calculating the respective power-based directional indicator value $\delta_s$ includes determining the difference between the dB power values.

As represented by block 7-5, the method 700 includes determining whether or not there are additional time-frequency unit pairings (corresponding to other sub-bands) remaining to consider. If there are additional time-frequency unit pairings remaining to consider ("Yes" path from block 7-5), the method circles back to the portion of the method represented by block 7-3. If there are not additional time-frequency unit pairings remaining to consider ("No" path from block 7-5), as represented by block 7-6, the method 700 includes determining one or more second directional indicator values from the at least two of the respective audible signal data components used to determine the power-based directional indicator values $\{\delta_s\}$, the one or more second directional indicator values are representative of a degree of similarity between the respective audible signal data components.

Figure 11:
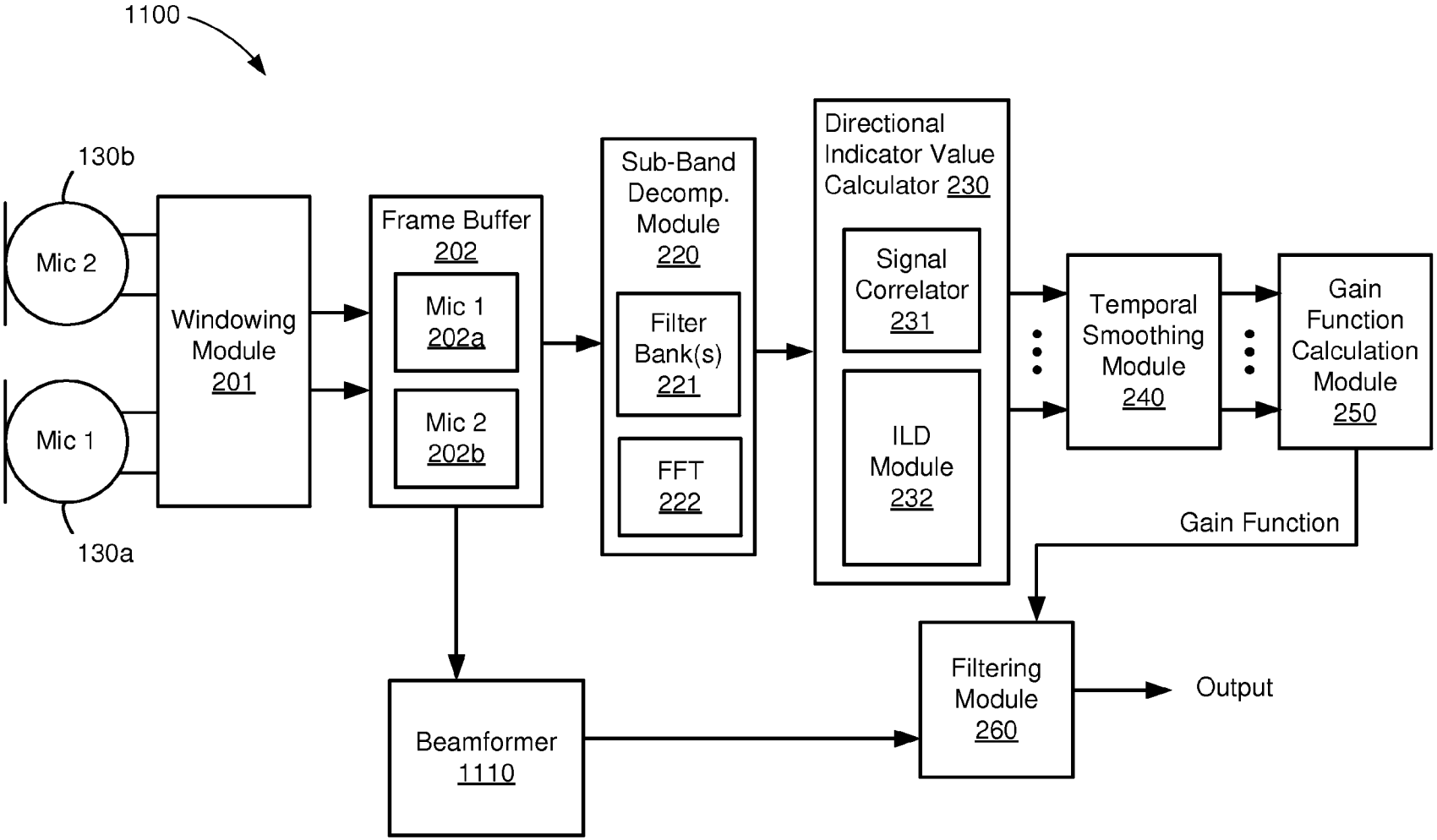
FIG. 11 is a block diagram of a directional filtering system including a beamformer module in accordance with some implementations.

FIG. 11 is a block diagram of a directional filtering system 1100 in accordance with some implementations. The directional filtering system 1100 illustrated in FIG. 11 is similar to and adapted from the directional filtering system 200 illustrated in FIG. 2. Elements common to FIGS. 2 and 11 include common reference numbers, and only the differences between FIGS. 2 and 11 are described herein for the sake of brevity. Moreover, while certain specific features are illustrated, those skilled in the art will appreciate from the present disclosure that various other features have not been illustrated for the sake of brevity, and so as not to obscure more pertinent aspects of the implementations disclosed herein.

To that end, the directional filtering system 1100 includes a beamformer module 1110. The beamformer module 1110 is coupled between the frame buffer 202 and the filtering module 260. The beamformer module 1110 is configured to combine the respective audible signal data components (received from the first and second microphones 130*a*, 130*b*) in order to enhance signal components associated with a particular direction, and/or attenuate signal components associated with other directions. Examples of suitable beamformers known in the art include delay-and-sum beamformers and null-steering beamformers. In operation, the gain function is applied to the output of the beamformer 1110 on a sub-band basis.

Figure 12:
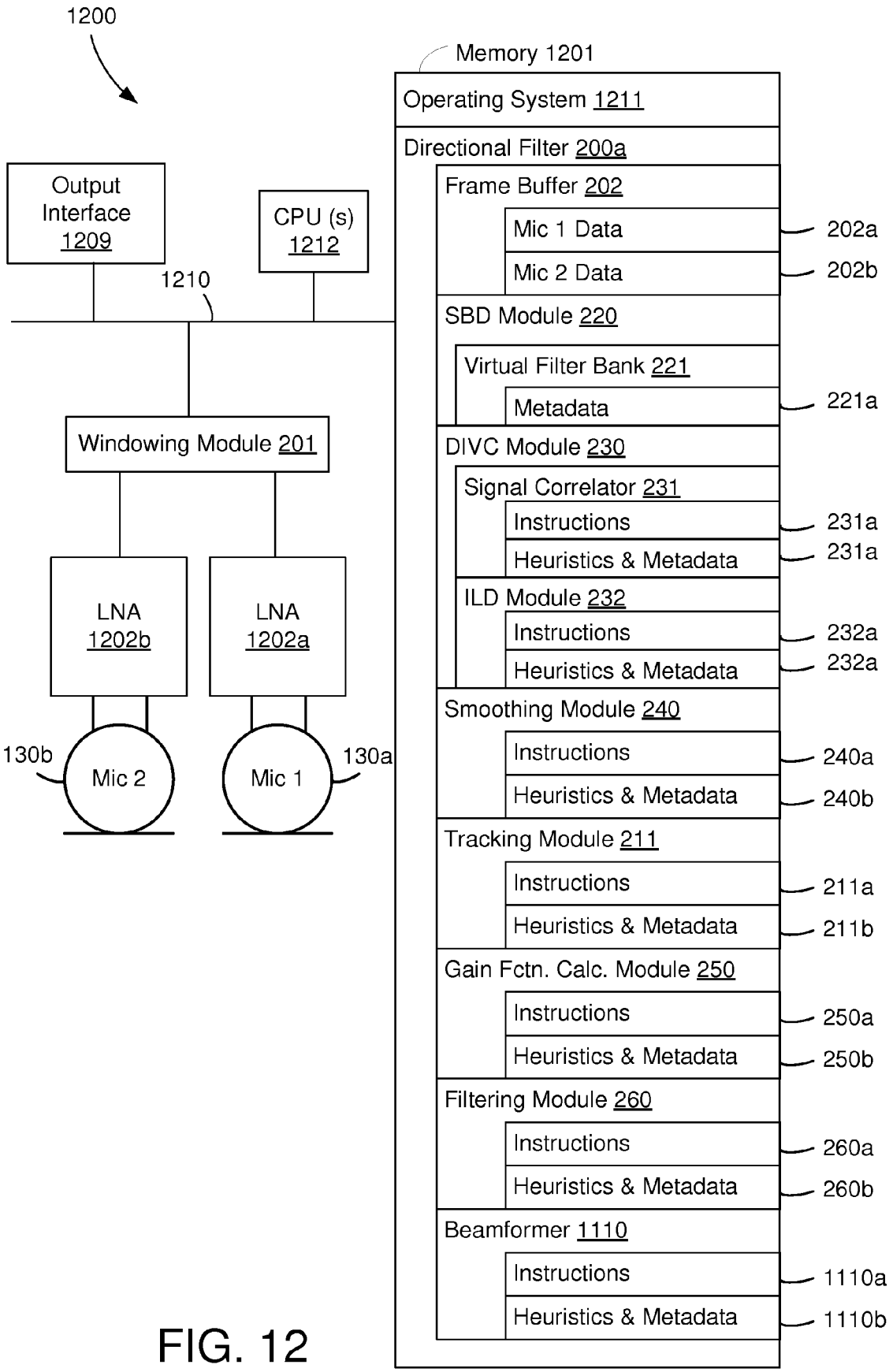
FIG. 12 is a block diagram of a directional filtering system in accordance with some implementations.

FIG. 12 is a block diagram of a directional filtering system 1200 in accordance with some implementations. The directional filtering system 1200 illustrated in FIG. 12 is similar to and adapted from the directional filtering system 200 of FIG. 2. Elements common to both implementations include common reference numbers, and only the differences between FIGS. 2 and 12 are described herein for the sake of brevity. Moreover, while certain specific features are illustrated, those of ordinary skill in the art will appreciate from the present disclosure that various other features have not been illustrated for the sake of brevity, and so as not to obscure more pertinent aspects of the implementations disclosed herein.

To that end, as a non-limiting example, in some implementations the directional filtering system 1200 includes one or more processing units (CPU's) 1212, one or more output interfaces 1209, a memory 1201, first and second low-noise amplifiers (LNA) 1202*a*, 1202*b*, first and second microphones 130*a*, 130*b*, a windowing module 201 and one or more communication buses 1210 for interconnecting these and other components not illustrated for the sake of brevity.

The first and second microphones 130*a*, 130*b* are respectively coupled to the corresponding the first and second LNAs 1202*a*, 1202*b*. In turn, the windowing module 201 is coupled between the first and second LNAs 1202*a*, 1202*b* and the communication bus 1210. The windowing module 201 is configured to generate two or more temporal frames of the audible signal.

The communication bus 1210 includes circuitry that interconnects and controls communications between system components. In some implementations, the memory 1201 includes high-speed random access memory, such as DRAM, SRAM, DDR RAM or other random access solid state memory devices; and may include non-volatile memory, such as one or more magnetic disk storage devices, optical disk storage devices, flash memory devices, or other non-volatile solid state storage devices. The memory 1201 may optionally include one or more storage devices remotely located from the CPU(s) 1212. The memory 1201, including the non-volatile and volatile memory device(s) within the memory 1201, comprises a non-transitory computer readable storage medium. In some implementations, the memory 1201 or the non-transitory computer readable storage medium of the memory 1201 stores the following programs, modules and data structures, or a subset thereof including an optional operating system 1211 and a directional filter module 200*a*. The directional filter module 200*a* includes at least some portions of a frame buffer 202, a voice activity detector 210, a tracking module 211, a sub-band decomposition (SBD) module 220, a directional indicator value calculator (DIVC) module 230, a temporal smoothing module 240, a gain function calculation (GFC) module 250, a filtering module 260, and a beamformer module 1100.

The operating system 1211 includes procedures for handling various basic system services and for performing hardware dependent tasks.

Temporal frames of the composite audible signal data, produced by the windowing module 201, are stored in the frame buffer 202. As shown, the frame buffer 202 includes respective allocations of storage 202*a*, 202*b* for the corresponding audible signal data components provided by the first and second microphones 130*a*, 130*b*. In other words, a frame buffer includes a respective allocation of storage for a corresponding audible signal data component provided by one of a plurality of audio sensors.

The SBD module 220 is provided to convert one or more audible signal data components into one or more corresponding sets of time-frequency units. The time dimension of each time-frequency unit includes at least one of a plurality of time intervals within a temporal frame. The frequency dimension of each time-frequency unit includes at least one of a plurality of sub-bands contiguously distributed throughout the frequency spectrum associated with the corresponding audible signal data component. In some implementations, the plurality of sub-bands is distributed throughout the frequency spectrum associated with voiced sounds. In some implementations, the SBD module 220 includes a virtual filter bank 221, which has an allocation of memory for metadata 221*a*.

The DIVC module 230 is configured to determine one or more directional indicator values from the composite audible signal data. To that end, in some implementations, the DIVC module 230 includes a signal correlator module 231 and an inter-microphone level difference (ILD) module 232, each configured to determine a corresponding type of directional indicator value as described above. To those ends, in some implementations, the signal correlator module 231 includes a set of instructions 231*a*, and heuristics and metadata 231*b*, and the ILD module 232 includes a set of instructions 232*a*, and heuristics and metadata 232*b*.

The temporal smoothing module 240 is provided to optionally decrease a respective time variance value associated with a particular directional indicator value. To that end, the temporal smoothing module 240 includes a set of instructions 240*a*, and heuristics and metadata 240*b*.

The GFC module 250 is configured to determine a gain function G from the one or more directional indicator values produced by the DIVC 230 (or, optionally the temporal smoothing module 240). To that end, the GFC module 250 includes a set of instructions 250*a*, and heuristics and metadata 250*b*.

The filtering module 260 is configured to adjust the spectral composition of the composite audible signal data using the gain function G (or one or more of the component-gain functions) in order to produce directionally filtered audible signal data. To that end, the filtering module 260 includes a set of instructions 260*a*, and heuristics and metadata 260*b*.

The tracking module 211 is configured to adjust one or more of the respective target values ($\tau_0$, $\delta_0$) based on voice activity in the composite audible signal data. To that end, the tracking module 211 includes a set of instructions 211*a*, and heuristics and metadata 211*b*.

The beamformer module 1110 is configured to combine the respective audible signal data components (received from the first and second microphones 130*a*, 130*b*) in order to enhance signal components associated with a particular direction, and/or attenuate signal components associated with other directions. To that end, the beamformer module 1110 includes a set of instructions 1110*a*, and heuristics and metadata 1110*b*.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, which changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. A method of directionally filtering portions of an audible signal, the method comprising:

determining one or more directional indicator values from composite audible signal data, the composite audible signal data including a respective audible signal data component from each of a plurality of audio sensors;

determining a gain function from the one or more directional indicator values, the gain function targeting one or more portions of the composite audible signal data, wherein generating the gain function from the one or more directional indicator values includes determining, for each directional indicator value, a respective component-gain function based on the directional indicator value and a corresponding target value associated with the directional indicator value, and the respective component-gain function includes a distance function of the directional indicator value and the corresponding target value; and filtering the composite audible signal data using the gain function in order to produce directionally filtered audible signal data, the directionally filtered audible signal data including one or more portions of the composite audible signal data that have been changed by filtering with the gain function.

2. The method of claim 1, further comprising obtaining the composite audible signal data.

3. The method of claim 2, wherein obtaining the composite audible signal data includes receiving the respective audible signal data components from the plurality of audio sensors.

4. The method of claim 3, wherein at least some of the plurality audio sensors are spatially separated from one another.

5. The method of claim 2, wherein obtaining the composite audible signal data includes retrieving the composite audible signal data from a non-transitory memory.

6. The method of claim 1, further comprising converting the composite audible signal data into a plurality of time-frequency units, wherein the time dimension of each time-frequency unit includes at least one of a plurality of time intervals, and wherein the frequency dimension of each time-frequency unit includes at least one of a plurality of sub-bands.

7. The method of claim 6, wherein converting the composite audible signal data into the plurality of time-frequency units includes individually converting some of the respective audible signal data components into corresponding sets of time-frequency units included in the plurality of time-frequency units.

8. The method of claim 6, wherein converting the composite audible signal data into the plurality of time-frequency units includes applying a Fast Fourier Transform to one or more of the respective audible signal data components.

9. The method of claim 6, wherein converting the composite audible signal data into the plurality of time-frequency units includes:

dividing a respective frequency domain representation of each of one or more of the respective audible signal data components into a plurality of sub-band data units; and generating a respective time-series representation of each of the plurality of sub-band data units, each respective time-series representation comprising a time-frequency unit.

10. The method of claim 9, further comprising generating the respective frequency domain representation of each of the one or more of the respective audible signal data components by utilizing one of gamma-tone filter bank, a short-time Fourier transform, a wavelet decomposition module, and a bank of one or more interaural intensity difference (IID) filters.

11. The method of claim 1, wherein determining the one or more directional indicator values from the composite audible signal data includes determining one or more first directional indicator values from at least two of the respective audible signal data components, the one or more first directional indicator values are representative of a degree of similarity between the respective audible signal data components.

12. The method of claim 11, wherein determining the one or more first directional indicator values includes:

calculating, for each of the one or more first directional indicator values, a respective plurality of cross-correlation values between two of the respective audible signal data components for a corresponding plurality of time-lag values; and selecting, for each of the one or more first directional indicator values, the one of the plurality of time-lag values for which the corresponding one of the plurality of cross-correlation values more closely satisfies a criterion than the other cross-correlation values.

13. The method of claim 12, wherein calculating each of the one or more first directional indicator values includes correspondingly calculating the respective plurality of cross-correlation values on a sub-band basis by utilizing corresponding sets of time-frequency units from each of at least one pair of the respective audible signal data components.

14. The method of claim 11, wherein determining the one or more directional indicator values from the composite audible signal data includes determining one or more second directional indicator values from the at least two of the respective audible signal data components used to determine the first directional indicator value, the one or more second directional indicator values are representative of a level difference between the respective audible signal data components.

15. The method of claim 1, wherein determining the one or more directional indicator values from the composite audible signal data includes determining one or more first directional indicator values, each of the one or more first directional indicator values is a function of a respective level difference value for each of at least one pair of the respective audible signal data components, each respective level difference value providing an indicator of relative signal powers characterizing the pair of the respective audible signal data components.

16. The method of claim 15, wherein calculating the respective level difference values includes calculating the respective level difference values on a sub-band basis by utilizing corresponding sets of time-frequency units from each of at least one pair of the respective audible signal data components.

17. The method of claim 15, wherein calculating the respective level difference values includes determining a power level difference between each of at least one pair of the respective audible signal data components.

18. The method of claim 15, wherein calculating the respective level difference values includes:

dividing a respective time-series representation of each of at least one pair of the respective audible signal data components into a corresponding plurality of buffers;

summing respective powers in the corresponding pluralities of buffers; and determining the difference between the respective powers.

19. The method of claim 1, further comprising decreasing a respective time variance value characterizing at least one of the one or more directional indicator values.

20. The method of claim 19, wherein decreasing the respective time variance value includes filtering the at least one of the one or more directional indicator values using at least one of a low pass filter, a running median filter, a Kalman filter and a leaky integrator.

21. The method of claim 1, wherein the distance function includes an exponential function of the difference between the directional indicator value and the corresponding target value.

22. The method of claim 1, wherein the respective component-gain function includes a sigmoid function of the distance function.

23. The method of claim 1, further comprising:

detecting the presence of voice activity in at least one of the respective audible signal data components; and adjusting the corresponding target value in response to the detection of the voice activity.

24. The method of claim 1, further comprising:

detecting a change of voice activity between at least two of the respective audible signal data components; and adjusting the corresponding target value in response to the detection of the change of voice activity.

25. The method of claim 1, further comprising combining two or more component-gain functions respectively corresponding to each of two or more directional indicator values in order to determine the gain function.

26. The method of claim 1, wherein filtering the composite audible signal data includes applying the gain function to one or more time-frequency units of the composite audible signal data.

27. The method of claim 1, further comprising selecting, as the one or more portions of the composite audible signal data targeted by the gain function, one or more portions of the composite audible signal data that include audible signal data from a target source.

28. The method of claim 1, further comprising selecting, as the one or more portions of the composite audible signal data targeted by the gain function, one or more portions of the composite audible signal data that include audible voice activity from a target source.

29. A directional filter comprising:

a processor; a non-transitory memory including instructions that when executed by the processor cause the directional filter to:

determine one or more directional indicator values from composite audible signal data, the composite audible signal data including a respective audible signal data component from each of a plurality of audio sensors;

determine a gain function from the one or more directional indicator values, the gain function targeting one or more portions of the composite audible signal data, wherein determining the gain function from the one or more directional indicator values includes determining, for each directional indicator value, a respective component-gain function based on the directional indicator value and a corresponding target value associated with the directional indicator value, and the respective component-gain function includes a distance function of the directional indicator value and the corresponding target value; and filter the composite audible signal data using the gain function in order to produce directionally filtered audible signal data, the directionally filtered audible signal data including one or more portions of the composite audible signal data that have been changed by filtering with the gain function.

30. The directional filter of claim 29, wherein the non-transitory memory also includes instructions that when executed by the processor cause the directional filter to convert the composite audible signal data into a plurality of time-frequency units, wherein the time dimension of each time-frequency unit includes at least one of a plurality of time intervals, and wherein the frequency dimension of each time-frequency unit includes at least one of a plurality of sub-bands.

31. The directional filter of claim 29, where the instructions for determining the one or more directional indicator values include instructions for determining one or more first directional indicator values from at least two of the respective audible signal data components, the one or more first directional indicator values are representative of a degree of similarity between the respective audible signal data components.

32. The directional filter of claim 31, where the instructions for determining the one or more directional indicator values include instructions for determining one or more second directional indicator values from the at least two of the respective audible signal data components used to determine the first directional indicator value, the one or more second directional indicator values are representative of a level difference between the respective audible signal data components.

33. The directional filter of claim 29, where the instructions for determining the one or more directional indicator values include instructions for determining one or more first directional indicator values, each of the one or more first directional indicator values is a function of a respective level difference value for each of at least one pair of the respective audible signal data components, each respective level difference value providing an indicator of relative signal powers characterizing the pair of the respective audible signal data components.

34. The directional filter of claim 33, wherein the instructions for determining the one or more first directional indicator values include instructions for calculating the respective level difference values on a sub-band basis by utilizing corresponding sets of time-frequency units from each of at least one pair of the respective audible signal data components.

35. The directional filter of claim 29, wherein the non-transitory memory also includes instructions that when executed by the processor cause the directional filter to decrease a respective time variance value characterizing at least one of the one or more directional indicator values.

36. The directional filter of claim 29, wherein the non-transitory memory also includes instructions that when executed by the processor cause the directional filter to adjust the target value in response the detection of a voiced sound.

37. The directional filter of claim 29, wherein the non-transitory memory also includes instructions that when executed by the processor cause the directional filter to combine one or more of the respective component-gain functions.

38. The directional filter of claim 29, wherein the non-transitory memory also includes instructions that when executed by the processor cause the directional filter to combine the respective audible signal data components in order to one of: enhance signal components associated with a particular direction; and attenuate signal components associated with other directions.

39. A directional filter comprising:

a directional indicator value calculator configured to determine one or more directional indicator values from composite audible signal data, the composite audible signal data including a respective audible signal data component from each of a plurality of audio sensors;

a gain function calculator configured to determine a gain function from the one or more directional indicator values, the gain function targeting one or more portions of the composite audible signal data, wherein generating the gain function from the one or more directional indicator values includes determining, for each directional indicator value, a respective component-gain function based on the directional indicator value and a corresponding target value associated with the directional indicator value, and the respective component-gain function includes a distance function of the directional indicator value and the corresponding target value; and a filter module configured to apply the gain function to the composite audible signal data in order to produce directionally filtered audible signal data.

40. The directional filter of claim 39, further comprising a windowing module configured to generate a plurality of temporal frames of the composite audible signal data, the composite audible signal data including a respective audible signal data component from each of a plurality of audio sensors.

41. The directional filter of claim 39, further comprising a sub-band decomposition module configured to convert the composite audible signal data into a plurality of time-frequency units.

42. The directional filter of claim 39, further comprising a temporal smoothing module configured to decrease a respective time variance value characterizing at least one of the one or more directional indicator values.

43. The directional filter of claim 39, further comprising a tracking module configured to adjust a target value associated with at least one of the one or more directional indicator values in response to an indication of voice activity in at least a portion of the composite audible signal data.

44. The directional filter of claim 43, further comprising a voice activity detector configured to provide a voice activity indicator value to the tracking module, the voice activity indicator value providing a representation of whether or not at least a portion of the composite audible signal data includes data indicative of voiced sound.

45. The directional filter of claim 39, further comprising a beamforming module configure to combine the respective audible signal data components in order to one of enhance signal components associated with a particular direction, and attenuate signal components associated with other directions.

46. A directional filter comprising:

means for determining one or more directional indicator values from composite audible signal data, the composite audible signal data including a respective audible signal data component from each of a plurality of audio sensors;

means for determining a gain function from the one or more directional indicator values, the gain function targeting one or more portions of the composite audible signal data wherein generating the gain function from the one or more directional indicator values includes determining, for each directional indicator value, a respective component-gain function based on the directional indicator value and a corresponding target value associated with the directional indicator value, and the respective component-gain function includes a distance function of the directional indicator value and the corresponding target value; and means for applying the gain function to the composite audible signal data in order to produce directionally filtered audible signal data.

* * * * *